US008231120B2

(12) United States Patent
Hayashi et al.

(10) Patent No.: US 8,231,120 B2
(45) Date of Patent: Jul. 31, 2012

(54) SHEET PROCESSING APPARATUS, IMAGE FORMING APPARATUS, AND IMAGE FORMING SYSTEM

(75) Inventors: Kenichi Hayashi, Abiko (JP); Kiyoshi Watanabe, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 55 days.

(21) Appl. No.: 12/890,189

(22) Filed: Sep. 24, 2010

(65) Prior Publication Data

US 2011/0081184 A1 Apr. 7, 2011

(30) Foreign Application Priority Data

Oct. 7, 2009 (JP) ..... 2009-233000

(51) Int. Cl.
*B31F 1/10* (2006.01)

(52) U.S. Cl. ..... 270/45; 270/58.07

(58) Field of Classification Search ..... 270/32, 270/45, 58.07; 493/406, 407, 442, 454
See application file for complete search history.

(56) References Cited

U.S. PATENT DOCUMENTS

| | | | | |
|---|---|---|---|---|
| 5,443,248 | A | 8/1995 | Hayashi et al. | |
| 5,735,515 | A | 4/1998 | Hayashi et al. | |
| 5,951,000 | A | 9/1999 | Sato et al. | |
| 6,692,208 | B1 | 2/2004 | Watkiss et al. | |
| 7,147,598 | B2 * | 12/2006 | Fujimoto et al. | 493/405 |
| 7,285,084 | B2 * | 10/2007 | Fujimoto et al. | 493/442 |
| 7,594,645 | B2 * | 9/2009 | Suzuki et al. | 270/37 |
| 7,681,872 | B2 | 3/2010 | Hayashi | |
| 2005/0189688 | A1 * | 9/2005 | Suzuki et al. | 270/32 |
| 2008/0101836 | A1 | 5/2008 | Fujita et al. | |

FOREIGN PATENT DOCUMENTS

| | | |
|---|---|---|
| EP | 1138521 A2 | 10/2001 |
| ES | 2249235 | 4/2006 |
| GB | 2360013 B | 11/2002 |

* cited by examiner

*Primary Examiner* — Leslie A Nicholson, III
(74) *Attorney, Agent, or Firm* — Fitzpatrick, Cella, Harper & Scinto

(57) ABSTRACT

A sheet processing apparatus includes a holding portion that nips and holds a booklet, which includes folded sheets, by a pair of holding members opposite to each other; and a pressing portion that enters a gap between the pair of holding members, wherein the pressing portion presses the spine of the held booklet so as to deform the spine of the booklet; wherein the pressing portion has plurality of pressing members, each having a different thickness in the thickness direction of the booklet, and the pressing member capable of entering the gap between the pair of holding members, and having the thickness closest to the thickness of the booklet which is nipped and held by the pair of holding members is selected among the plurality of pressing members so as to perform the deforming process.

11 Claims, 22 Drawing Sheets

SHEET PROCESSING APPARATUS, IMAGE FORMING APPARATUS, AND IMAGE FORMING SYSTEM

BACKGROUND OF THE INVENTION

1. Field of the Invention

The present invention relates to a sheet processing apparatus, an image forming apparatus, and an image forming system that deforms a spine of a booklet made of a folded sheet bundle.

2. Description of the Related Art

Conventionally, when a sheet bundle including about 20 or more sheets is folded at a time, a booklet is formed having a vicinity of a spine being curved. The folded state of the booklet including the sheet bundle folded as described above is insufficient, so that the booklet is soon opened even after it is folded. Therefore, the appearance is degraded. The booklet described above cannot lie flat, so that it is difficult to stack a great number of booklets.

In order to solve the problem described above, there has been proposed a method and an apparatus of squaring a spine of a booklet as one of deforming processes in which the spine of the booklet is pressed to be deformed into a rectangular shape (U.S. Pat. No. 6,692,208).

According to a conventional apparatus illustrated in FIGS. 21A to 21F, a booklet 701 is conveyed by conveying portions 706 and 707 with a spine of the booklet 701 set to the leading position, and the spine of the booklet 701 is brought into contact with a positioning portion 705 for positioning (FIG. 21B). Then, as illustrated in FIG. 21C, grip portions 702 and 703 nip the adjacent portion of the spine of the booklet 701, and the positioning portion 705 is retracted. A pressing roller 704 travels along the spine of the booklet 701, which projects from the grip portions 702 and 703 and which is curved, so as to apply pressure. In this manner, the curved spine of the booklet 701 is deformed into a rectangular shape.

FIG. 21A is a schematic diagram illustrating the traveling direction of the pressing roller 704. The pressing roller 704 is retracted to an area where it is not in contact with the booklet 701, before the grip portions 702 and 703 nip the booklet 701. When the grip portions 702 and 703 nip and hold the booklet 701, the pressing roller 704 moves from one end to the other end of the booklet 701 as applying pressure to the spine.

FIG. 21E illustrates the spine, which is pressed and squared, of the booklet 701, while FIG. 21D illustrates the state in which the booklet 701, which has already been subject to the deforming (squaring) process, is discharged onto a discharge tray 708.

However, since the spine, which projects from the grip portions 702 and 703, of the booklet 701 is pressed, the deformed portions 709*a* and 709*b* of the spine, which are subject to the deforming process, might protrude outward as illustrated in FIG. 21F, when the protruding amount is great. This gives less attractive appearance. Further, there arises a problem that, when the grip portions 702 and 703 hold the booklet 701, a pressing mark is formed at the portion around the spine of the booklet 701 by the corner portions 702*a* and 703*a* of the grip portions 702 and 703.

FIG. 22 illustrates the spine of the booklet that is subject to the squaring process. The corners 709*a* and 709*b* of the squared spine spread in the thickness direction of the booklet, so that the width of the squared plane unfavorably becomes greater than the thickness of the booklet. Further, the above-mentioned pressing mark is formed. Further, the sheet spine 709*c* at the center of the booklet, which does not have to be normally squared, is unfavorably deformed.

SUMMARY OF THE INVENTION

The present invention is accomplished in view of the above-mentioned problem, and aims to highly-attractively perform a squaring (deforming) process to a spine of a booklet without forming a pressing mark on the spine of the booklet.

A sheet processing apparatus for achieving the foregoing object includes a holding portion that nips and holds a booklet, which includes folded sheets, by a pair of holding members opposite to each other; and a pressing portion that enters a gap between the pair of holding members, wherein the pressing portion presses the spine of the held booklet so as to deform the spine of the booklet, wherein the pressing portion has a plurality of pressing members, each having a different thickness in a thickness direction of the booklet, and a pressing member among the plurality of pressing members, which is capable of entering the gap between the pair of holding members and which has a thickness closest to a thickness of the booklet which is nipped and held by the pair of holding members, is selected so as to perform the deforming of the spine of the booklet.

Further features of the present invention will become apparent from the following description of exemplary embodiments with reference to the attached drawings.

DESCRIPTION OF THE EMBODIMENTS

In the following, exemplary embodiments of the present invention will be described in detail as examples manner with reference to the drawings. Here, dimensions, materials, shapes, relative arrangements thereof and the like described in the following embodiment are to be appropriately modified according to a configuration of an apparatus to which the present invention is applied and various conditions. Therefore, the embodiments are not intended to limit the scope of the present invention only to the description unless otherwise specified.

In the present embodiment, an image forming system having an image forming apparatus main body and a sheet processing apparatus will be described as being exemplified. A sheet processing apparatus including a finisher 500, a saddle stitch binding portion 800, and a squaring processing portion 600 is illustrated as an example of the sheet processing apparatus. The sheet processing apparatus is not limited to the one described above. The sheet processing apparatus has an integrated configuration by various combinations of the finisher 500, the saddle stitch binding portion 800, the squaring processing portion 600, and other processing portions.

First Embodiment

Configuration of Image Forming System

Figure 1:
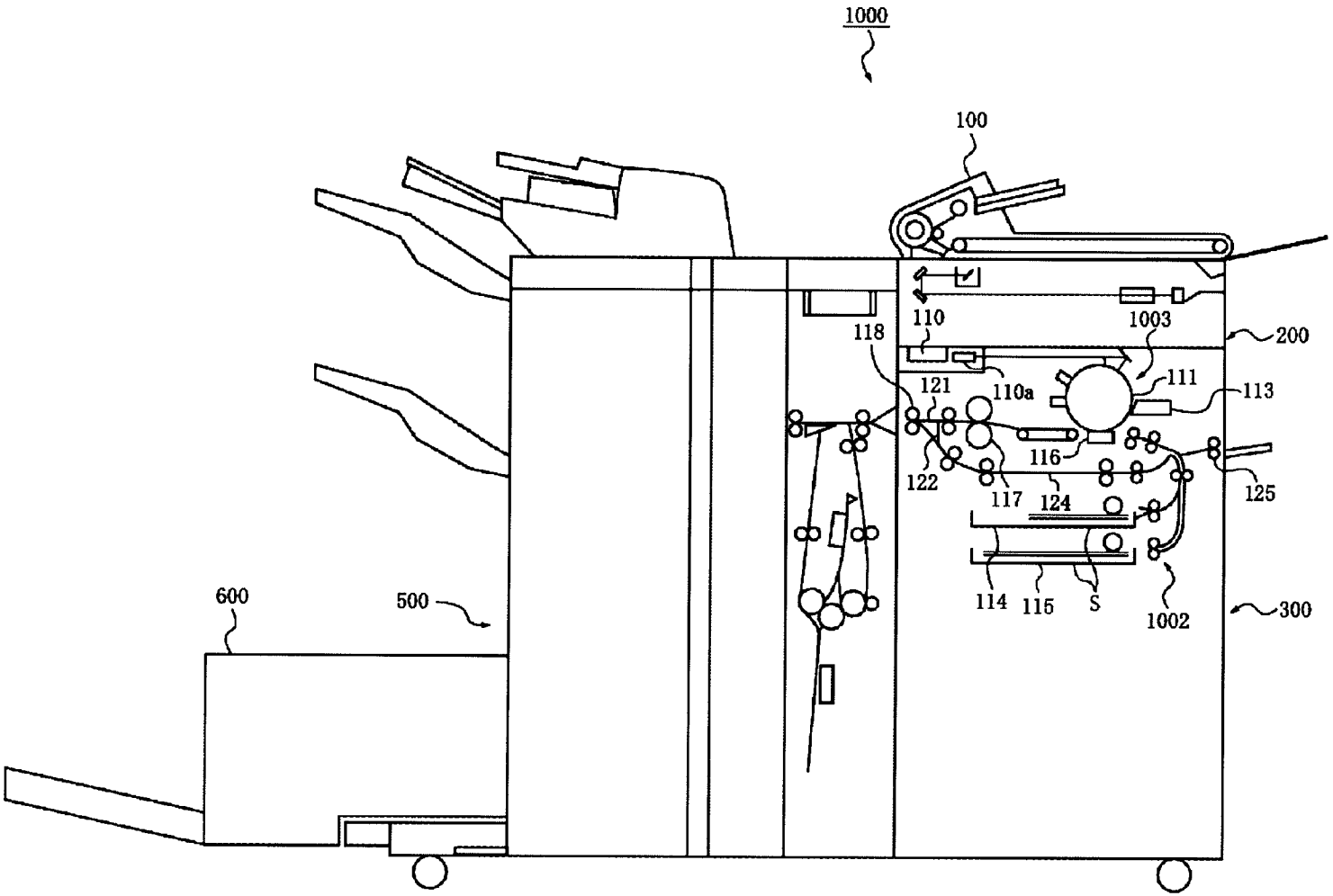
FIG. 1 is a sectional view illustrating an overall configuration of an image forming system to which a sheet processing apparatus according to a first embodiment of the present invention is applied.
Figure 2:
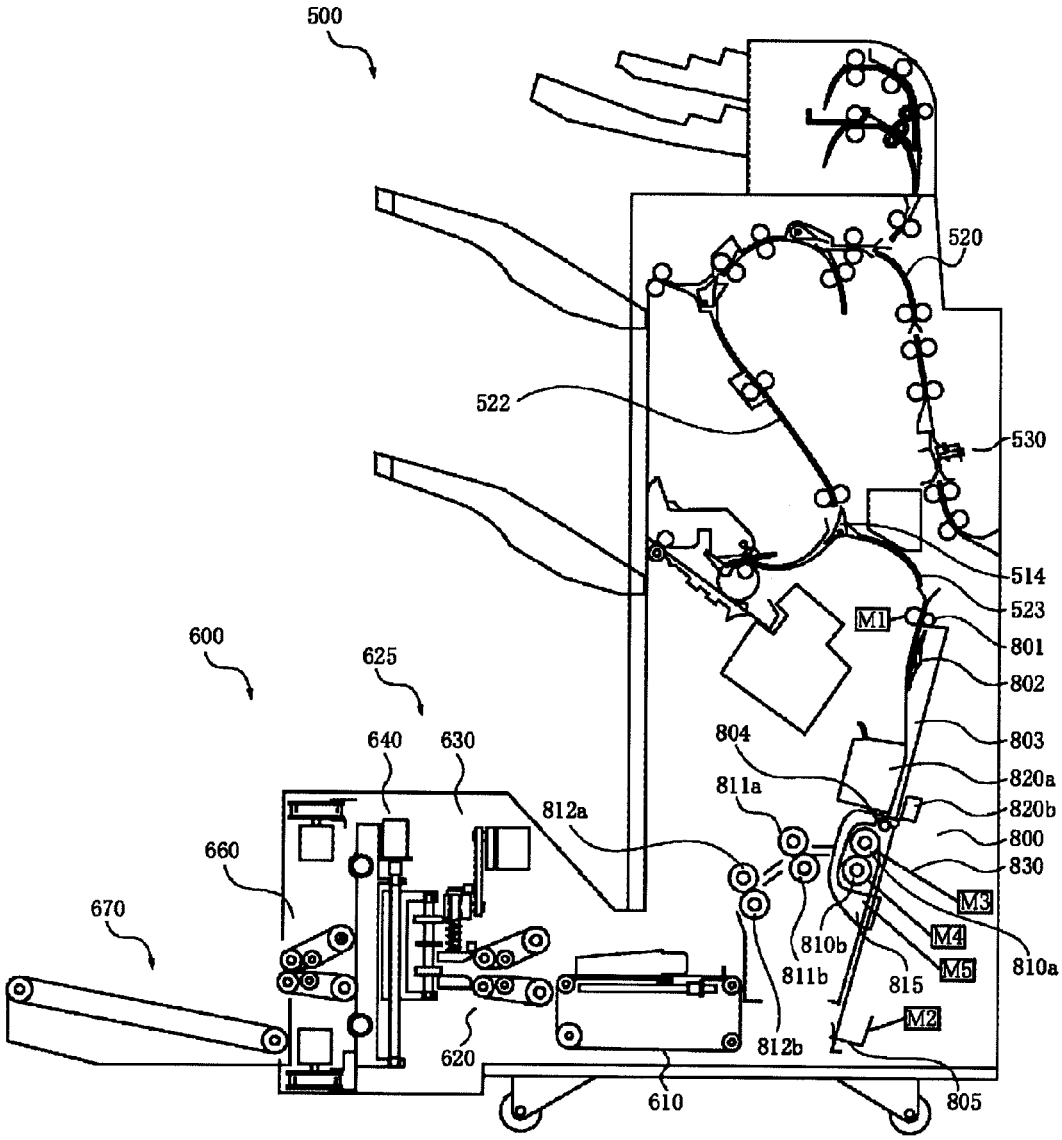
FIG. 2 is a sectional view illustrating a configuration of the sheet processing apparatus.

First, a general configuration of the image forming system is described with reference to FIGS. 1 and 2. FIG. 1 is a sectional view illustrating an overall configuration of a main part of an image forming system. FIG. 2 is a sectional view illustrating a main part of a sheet processing apparatus.

As illustrated in FIGS. 1 and 2, the image forming system 1000 includes an image forming apparatus main body 10 and a sheet processing apparatus 20. The sheet processing apparatus 20 includes a finisher 500, a saddle stitch binding portion 800, and a squaring processing portion 600. The saddle stitch binding portion 800 and the squaring processing portion 600 can be mounted as an option. The image forming apparatus main body 10 includes a document feed portion 100, an image reader 200 to read an image of a document and a printer 300 to record an image on a sheet.

(Configuration of Image Forming Apparatus Main Body)

A document is conveyed to a reading position by the document feed portion 100, and image data of the document read at the reading position by the image reader 200 is sent to an exposure controlling portion 110 with a predetermined imaging process performed thereto. The exposure controlling portion 110 outputs a laser beam according to an image signal. The laser beam is irradiated on a photosensitive drum 111 as being scanned by a polygon mirror 110*a*. An electrostatic latent image according to the scanned laser beam is formed at the photosensitive drum 111 constituting an image forming portion 1003. The electrostatic latent image formed on the photosensitive drum 111 is developed by a development device 113, and made visible as a toner image.

On the other hand, a sheet is conveyed to a transfer portion 116 from any one of cassettes 114 and 115, a manual feed portion 125, and a duplex conveying path 124, those of which constitute a feed portion 1002. The toner image, which is made visible, is transferred onto the sheet at the transfer portion 116. The sheet after the transfer is subject to a fixing process at a fixing portion 117.

The sheet passing through the fixing portion 117 is temporarily guided to a path 122 by a changeover member 121, and after the trailing end of the sheet completely passes through the changeover member 121, the sheet is switched back to be guided to a discharge roller 118 by the changeover member 121. The sheet is then discharged from the printer 300 by the discharge roller 118. Thus, the sheet is discharged from the printer 300 in a state that the surface having the toner image formed thereon faces downward (face-down). This discharge mode is called reverse discharge.

The sheet is discharged from the apparatus with the face-down state as described above, whereby an image forming process is performed one by one from a head page. In this case, the order of pages can be registered when the image forming process is performed by using the document feed portion 100 or when the image forming process is performed to image data from the computer.

When the image forming process is performed on both surfaces of the sheet, the sheet is directly guided toward the discharge roller 118 from the fixing portion 117, and immediately after the trailing end of the sheet completely passes through the changeover member 121, the sheet is switched back to be guided to the duplex conveying path 124 by the changeover member 121. The sheet guided to the duplex conveying path 124 is again fed between the photosensitive drum 111 and the transfer portion 116 as described above.

(Configuration of Sheet Processing Apparatus)

The sheet discharged from the printer 300 of the image forming apparatus main body 10 is sent to the finisher 500 constituting the sheet processing apparatus (sheet processing portion) 20.

The configuration of the finisher 500 will next be described with reference to FIGS. 1 and 2.

(Finisher)

The finisher 500 takes in the sheets discharged from the printer 300 by the discharge roller 118 and selectively performs a process to the sheet. The processes to the sheet include a process in which plural sheets taken in the finisher are aligned and bound up as one sheet bundle, a stapling process (binding process) of stapling a trailing end of the sheet bundle, a sorting process, and a non-sorting process. These sheet processes are selectively performed.

As illustrated in FIG. 2, the finisher 500 has a conveying path 520 that takes the conveyed sheet into the apparatus, wherein the sheet is conveyed to a lower discharge path 522 that feeds the sheet to the saddle stitch binding portion 800. The conveying path 520 is provided with a punch unit 530 that performs a punching process to the trailing end of the conveyed sheet, according to need, and plural pairs of conveying rollers.

A changeover member 514 is provided on the lower discharge path 522. The sheet guided to a saddle discharge path 523 is sent to the saddle stitch binding portion 800 by the changeover of the changeover member 514.

(Saddle Stitch Binding Portion)

Next, a configuration of the saddle stitch binding portion 800 will be described.

A sheet fed to the saddle stitch binding portion 800 is accepted by a pair of saddle inlet rollers 801, wherein a carry-in port is selected by a changeover member 802, which is operated by a solenoid, according to a size, and then, the sheet is carried in an accommodating guide 803 in the saddle stitch binding portion 800. The carried sheet is conveyed until the leading end thereof is brought into contact with a movable sheet positioning member 805 by a slide roller 804. A motor M1 drives the pair of saddle inlet rollers 801 and the slide roller 804. A stapler 820 is provided at the middle of the accommodating guide 803 so as to be arranged across the accommodating guide 803. The stapler 820 is divided into a driver 820*a* that projects staples and an anvil 820*b* that bends the projected staples. The sheet positioning member 805 stops at the portion where the central portion of the sheet in the sheet conveying direction is located at the binding position of the stapler 820, when the sheet is carried in. The sheet positioning member 805 is movable through the drive of a motor M2, and changes its position according to a sheet size.

A pair of folding rollers 810*a* and 810*b* is provided at the downstream side of the stapler 820. A projecting member 830 is provided at the position opposite to the pair of folding rollers 810*a* and 810*b* through the accommodating guide 803. The position where the projecting member 830 retracts from the accommodating guide 803 is specified as a home position. The projecting member 830 projects toward an accommodated sheet bundle, including plural sheets, by the drive of a motor M3. Thus, the sheet bundle is folded as being pushed into a nip between the pair of folding rollers 810*a* and 810*b*. Thereafter, the projecting member 830 returns again to the home position. Pressure sufficient for making a fold to the sheet bundle is applied between the pair of folding rollers 810*a* and 810*b* by a spring (not illustrated). The sheet bundle having the fold formed thereon is discharged toward a squaring processing portion 600 through a pair of first fold conveying rollers 811*a* and 811*b* and a pair of second fold conveying rollers 812*a* and 812*b*. Pressure sufficient for conveying and stopping the sheet bundle, on which the fold is formed, is applied respectively to the pair of first fold conveying rollers 811*a* and 811*b* and the pair of second fold conveying rollers 812*a* and 812*b*. The pair of folding rollers 810*a* and 810*b*, the pair of first fold conveying rollers 811*a* and 811*b*, and the pair of second fold conveying rollers 812*a* and 812*b* are rotated at the constant speed by the same motor M4.

When the sheet bundle is folded without performing the binding process, the sheet bundle is moved such that the center portion of the sheet bundle, accommodated in the accommodating guide 803, in the conveying direction is located at the nip position of the pair of folding rollers 810*a* and 810*b*. On the other hand, when the sheet bundle bound by the stapler 820 is folded, the sheet bundle at the stapling position is moved such that the stapling position (center portion in the conveying direction) of the sheet bundle is located at the nip position between the pair of folding rollers 810*a* and 810*b* after the stapling process is completed. With this process, the sheet bundle can be folded with the position where the stapling process is performed being defined as a center.

A pair of aligning plates 815, which surrounds the outer periphery of the pair of folding rollers 810*a* and 810*b* and which has a surface projecting to the accommodating guide 803, is provided at the position of the pair of folding rollers 810*a* and 810*b*. The pair of aligning plates 815 receives the drive of a motor M5 to move in the width direction, which is orthogonal to the conveying direction of the sheet, whereby the sheet accommodated in the accommodating guide 803 is aligned (positioned) in the width direction of the sheet.

The double-folded sheet bundle (folded sheet bundle: hereinafter referred to as a booklet) S is formed by the saddle stitch binding portion 800 thus configured. The booklet is not limited thereto, and includes the double-folded sheet bundle without performing the binding process.

(Squaring Processing Portion)

The squaring processing portion 600 will be described with reference to FIG. 4. FIG. 4 is an enlarged view of the squaring processing portion 600 in FIG. 2. The squaring processing portion 600 is located at the downstream side of the saddle stitch binding portion 800.

As illustrated in FIG. 4, in the squaring processing portion 600, a receiving portion 610 has a lower conveying belt 611 that extends in the conveying direction only at the lower part for receiving and conveying the booklet from the saddle stitch binding portion 800. When the booklet is received, the lower conveying belt 611 rotates in the conveying direction. Therefore, even if the booklet drops from the pair of second fold conveying rollers 812*a* and 812*b*, the lower conveying belt 611 can receive the booklet with the posture kept as it is conveyed without allowing the booklet to rotate.

A pair of side guides 612 is arranged at the outside of the lower conveying belt 611 across the lower conveying belt 611. The pair of side guides 612 operates in the width direction of the booklet (in the direction orthogonal to the conveying direction), thereby being capable of correcting the position of the booklet in the width direction. A pressing guide 614 for preventing the booklet being opened is formed at the upper part of the pair of side guides 612. The pressing guide 614 functions as a guide for smoothly feeding the booklet to the downstream side. A conveying projection 613 that moves parallel to the lower conveying belt 611 is arranged at both sides of the lower conveying belt 611. The conveying projection 613 moves in the forward and reverse directions with the speed substantially equal to the speed of the lower conveying belt 611. When a slippage is produced between the lower conveying belt 611 and the booklet, the conveying projection 613 is brought into contact with the trailing end of the booklet to surely push the trailing end of the booklet toward the downstream side. The lower conveying belt 611, the pair of side guides 612, and the conveying projection 613 respectively operate through drives of the motors SM1, SM2, and SM3.

In the squaring processing portion 600, the conveying portion 620 includes a lower conveying belt 621 and an upper conveying belt 622 for receiving the booklet from the receiving portion 610 and for conveying the same toward the downstream side. The upper conveying belt 622 can pivot about a supporting point 623 according to a thickness of the booklet. The upper conveying belt 622 is pressed against the lower conveying belt 621 by a spring (not illustrated). The upper and lower conveying belts 622 and 621 are driven by a motor SM4. An inlet detection sensor 615 detects that the booklet is received from the saddle stitch binding portion 800, and that the booklet is on the lower conveying belt 611. An outlet detection sensor 616 detects the booklet to output an input signal for operating the pair of side guides 612 and the conveying projection 613.

In the squaring processing portion 600, a deforming processing unit 625 includes a pressing unit 630 that nips and holds the vicinity of the spine of the booklet in the vertical direction, and a squaring unit 640 that positions the spine of the booklet and presses the spine of the booklet through the application of pressure to perform squaring.

The pressing unit 630 serving as a holding portion is divided into an upper unit that moves in the vertical direction and a lower pressing plate 631 that is fixed to a frame so as to be opposite to the upper unit. The upper unit includes a strong pressing base 632 that receives drive of a motor SM5 to move in the vertical direction through links 636, 637, and 638, and an upper pressing plate 633 that is coupled by a slide coupling member 634, wherein a compression spring 635 is arranged at the outer periphery of the slide coupling member 634. The pressing plates 631 and 633, which serve as a pair of holding members, constitute a holding portion that nips and holds the booklet, including folded sheets, between holding surfaces that are parallel to each other and opposite to each other. When the pressing base 632 is at the upper position, the upper and lower pressing plates 633 and 631 are separated from each other, wherein the booklet is conveyed between the upper and lower pressing plates 633 and 631. When the pressing base 632 is at the lower position, the booklet is firmly nipped and held by the upper and lower pressing plates 631 and 633 by the compression spring 635 that is expanded and compressed according to the thickness of the booklet. Since the contact surfaces to the booklet (holding surfaces) of the upper and lower pressing plates 633 and 631 are smooth surfaces having no projection, a pressing mark cannot be formed on the booklet when the booklet is nipped and held. A top dead center detection sensor 639 detects that the pressing base 632 is at the upper position. A thickness detection sensor (thickness detection portion) 681 detects the position of the upper pressing plate 633 when the booklet is fixed (nipped and held), thereby calculating the space between the holding surfaces to obtain the thickness of the held booklet.

Figure 4B:
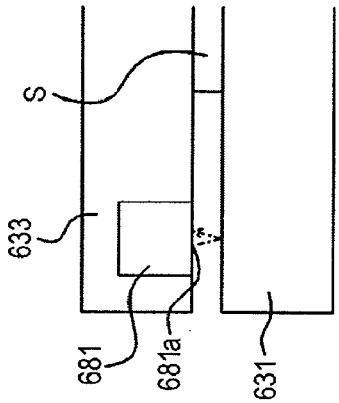
FIG. 4B is an enlarged view of a periphery of a thickness detection sensor.
Figure 4A:
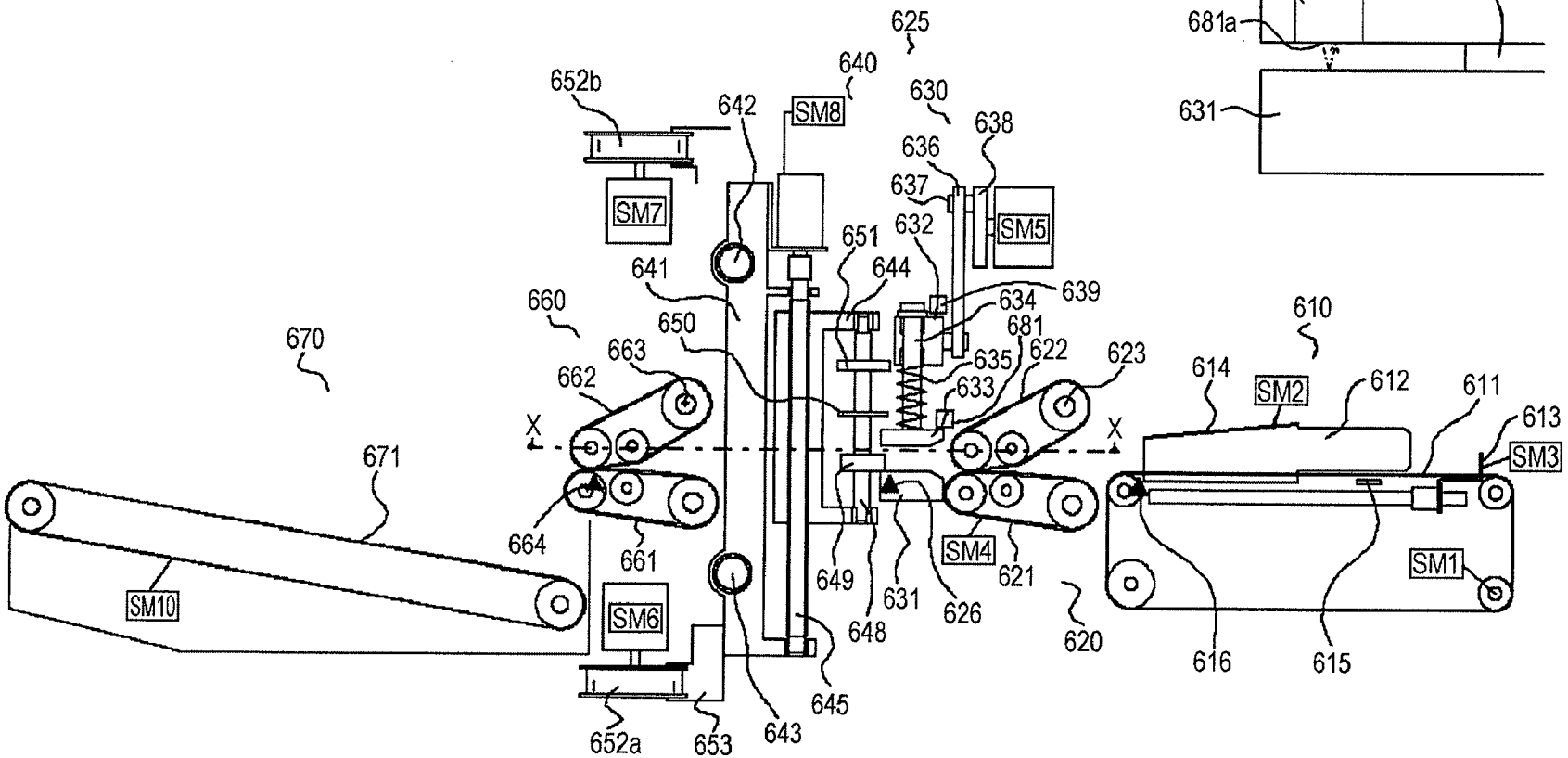
FIG. 4A is a sectional view illustrating a configuration of a squaring processing portion.

A thickness detection sensor 681 is, as illustrated in FIG. 4B, a distance-measuring sensor that converts a reflected light quantity (broken line) irradiated from a light-emitting portion 681*a* into a current value so as to measure a distance from a subject. The thickness detection sensor 681 is fixed to the upper pressing plate 633. The subject to be measured is the lower pressing plate 631. As the space between the upper and lower pressing plates 633 and 631 increases, i.e., as the thickness of the booklet is greater, the more the current value decreases. As described above, the thickness of the booklet held by the upper and lower pressing plates 633 and 631 can be measured. The booklet S is held between the upper and lower pressing plates 633 and 631.

Figure 5:
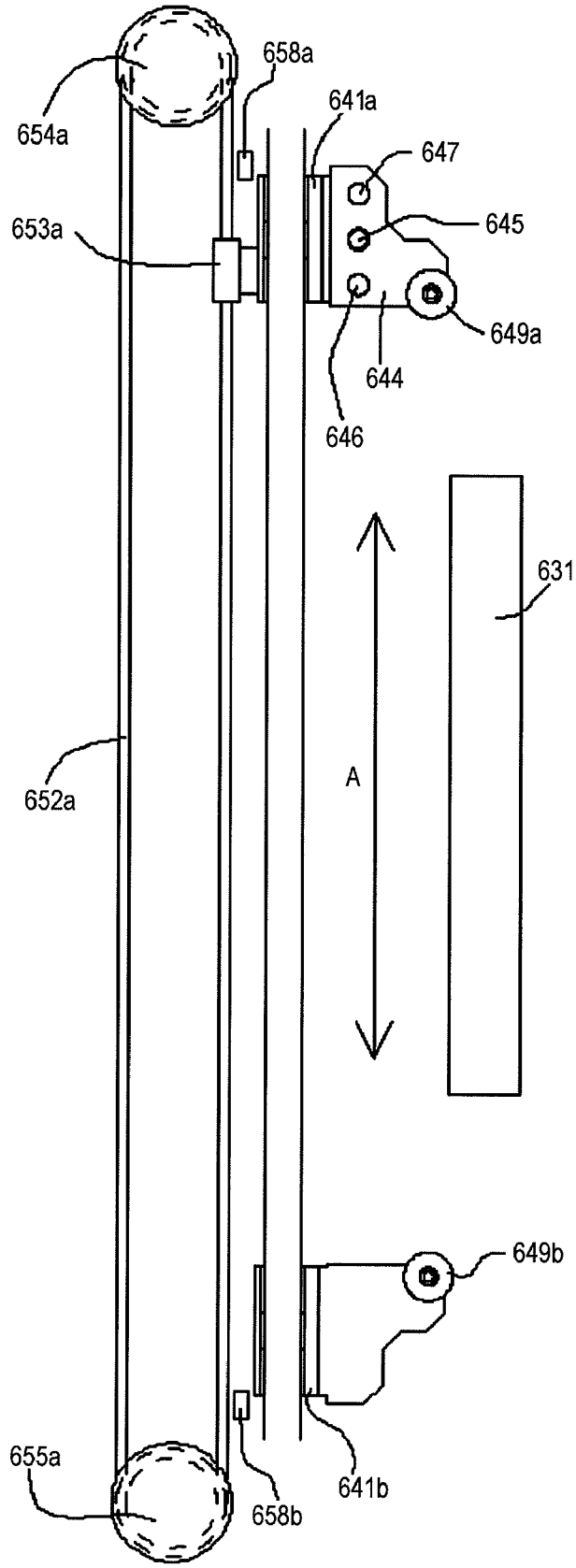
FIG. 5 is a top view of a squaring unit.

Next, the squaring unit 640 will be described with reference to FIGS. 4, 5, and 6. FIG. 5 is a view taken along a line X-X in FIG. 4, and FIG. 6 is a view when the squaring unit 640 in FIG. 4 is seen from the right side.

Figure 6:
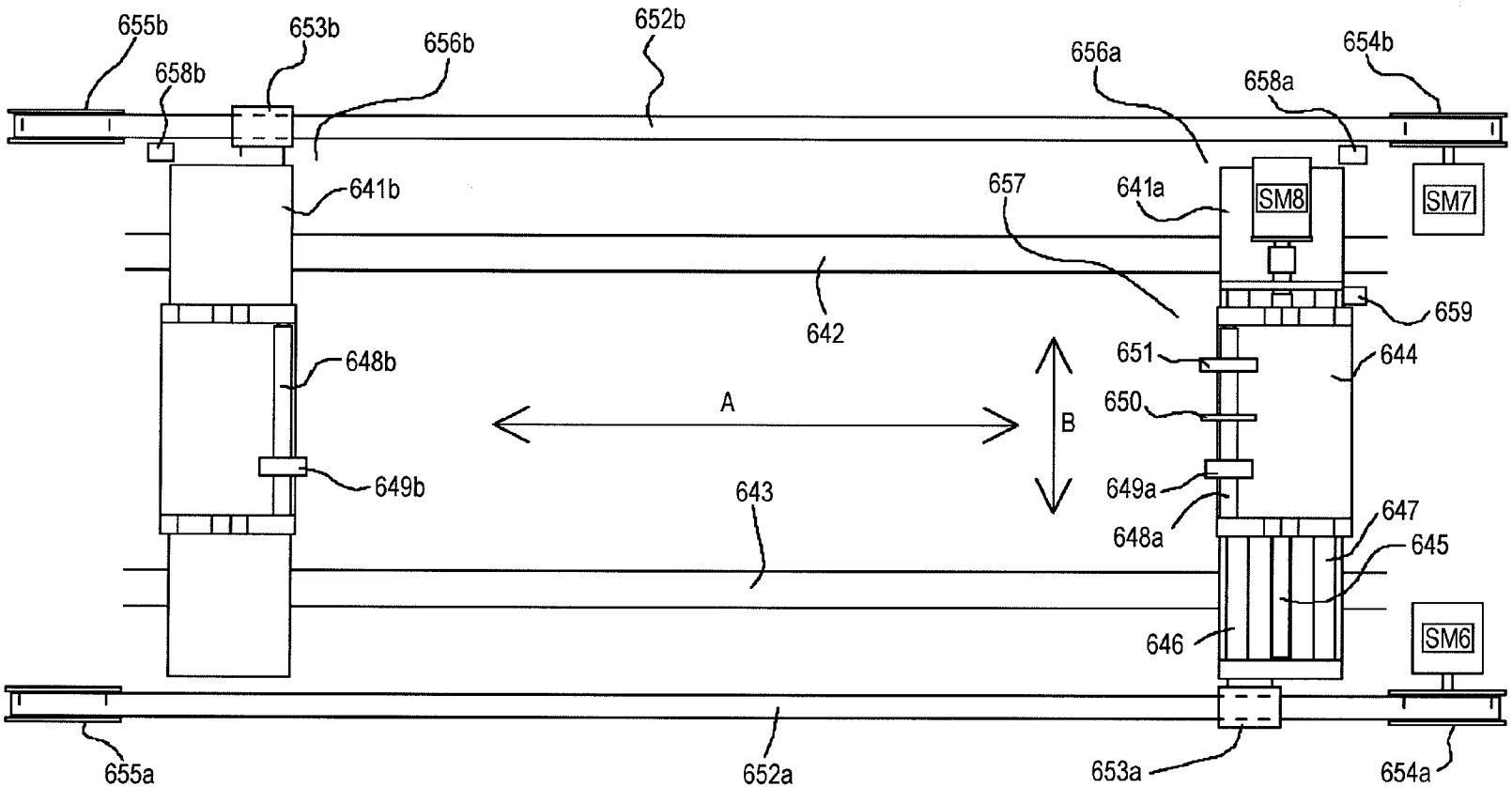
FIG. 6 is a front view of the squaring unit.

The squaring unit 640 is provided with a moving unit 656*a*, which is supported so as to be movable in a direction indicated by an arrow A in FIGS. 5 and 6 along slide shafts 642 and 643 that are supported by a frame (not illustrated). The moving unit 656*a* is mounted to a timing belt 652*a* by a coupling member 653*a*, and driven by a motor SM6 through pulleys 654*a* and 655*a*. The moving unit 656*a* has a moving base 641*a*, wherein a changeover unit 657 is slidably supported by slide shafts 646 and 647 fixed to the moving base 641*a*. The changeover unit 657 can move in a direction of B in FIG. 6 along the slide shafts 646 and 647 by a slide screw 645 and a motor SM8. In the changeover unit 657, a support shaft 648*a* is mounted to a changeover base 644 so as to be rotatable. A stopper member 649*a*, a first pressing member 650, and a second pressing member 651 are fixed to the support shaft 648*a*. The stopper member 649*a* is a positioning portion that positions, in cooperation with a later-described stopper member 649*b*, the booklet at a predetermined location where the squaring process is performed, through the abutment of the spine of the conveyed booklet to the stopper member 649*a*. The first pressing member 650 and the second pressing member 651 constituting the pressing portion is a pressing member that performs the squaring process in which the spine of the booklet is pressed. The first pressing member 650 and the second pressing member 651 are changed by the movement of the changeover unit 657 in the direction of B in FIG. 6 according to the thickness of the booklet. The changeover unit 657 has a reference position detection sensor 659, which becomes a reference position when the changeover unit 657 moves in the direction of B.

The squaring unit 640 also has a moving unit 656*b*, which is supported so as to be movable in the direction indicated by the arrow A in FIGS. 5 and 6 along the slide shafts 642 and 643 that are supported by the frame (not illustrated). The moving unit 656*b* is mounted to a timing belt 652*b* by a coupling member 653*b*, and driven by a motor SM7 through pulleys 654*b* and 655*b*. The moving unit 656*b* has a moving base 641*b*, wherein a support shaft 648 is mounted to the moving base 641*b* so as to be rotatable, and a stopper member 649*b* is fixed to the support shaft 648*b*. The stopper member 649*b* is a positioning portion that positions, in cooperation with the stopper member 649*a*, the booklet at a predetermined location where the squaring process is performed, through the abutment of the spine of the conveyed booklet to the stopper member 649*b*. The stopper members 649*a* and 649*b* are mounted in such a manner that they position the location of the conveyed booklet S in the sheet conveying direction, and receive the booklet S at the position separated from each other by a predetermined space in the sheet width direction in order to correct the tilt of the booklet S. The location of the spine of the booklet, which is positioned by the stopper members 649*a* and 649*b*, is at the position inward from the end portions of the upper and lower pressing plates 631 and 633, which serve as the pair of holding members constituting the holding portion, by a predetermined amount.

The moving units 656*a* and 656*b* are respectively provided with reference position detection sensors 658*a* and 658*b*, which become reference positions when the squaring unit 640 moves in the direction of A in the figure. The direction of A is orthogonal to the conveying direction of the booklet, and is along the spine of the booklet.

The stopper members 649*a* and 649*b*, the first pressing member 650, and the second pressing member 651 are members having a disk-like shape, and they have the relationship in size as illustrated in FIG. 7. As illustrated in FIGS. 7A and 7B, the diameter of each of the stopper members 649*a* and 649*b* is D1. The stopper members 649*a* and 649*b* enter the gap between the holding surfaces of the upper and lower pressing plates 633 and 631 so as to position the booklet S1 at the predetermined location where the booklet S1 does not protrude from the end portion of the upper and lower pressing plates 633 and 631 at the downstream side in the conveying direction. The thickness of each of the stopper members 649*a* and 649*b* is H1, which is higher than the thickness of the conveyed booklet, so that even a thick booklet can be positioned in such a manner that the spine thereof does not go over the stopper member.

The first pressing member 650, which is used for a booklet thinner than the booklet for the second pressing member 651, is adjacent to the stopper member 649*a*. This is a consideration point for enhancing a processing capability to a thin booklet, which has high productivity during the creation of booklets. With this configuration, the time taken to change the stopper member 649*a* to the first pressing member 650 and vice versa is decreased.

Figure 7E:
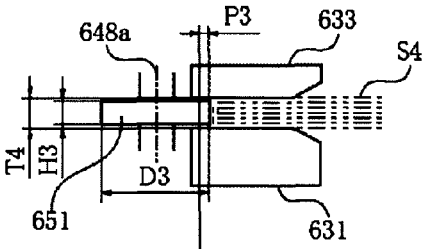
FIGS. 7A to 7F are enlarged views of essential parts illustrating the relationship between the space between holding surfaces of pressing plates and each member.
Figure 7F:
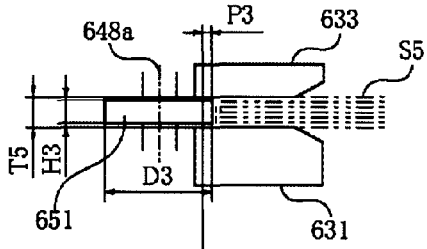
Figure 7C:
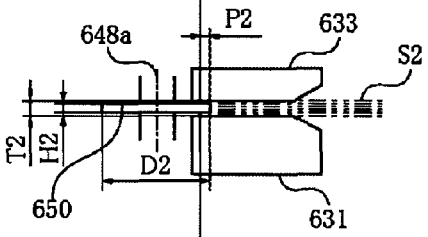
Figure 7D:
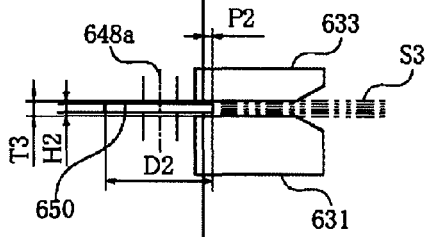
Figure 7A:
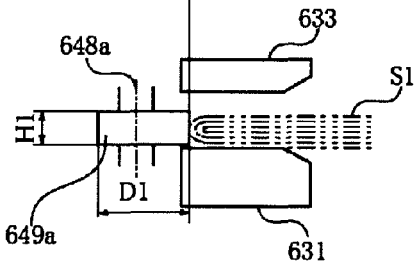
Figure 7B:
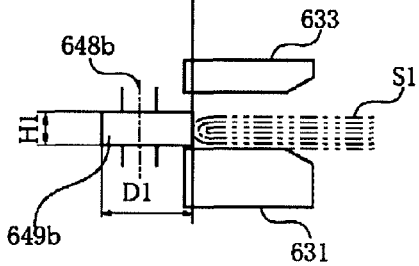

Here, a booklet formed by folding a single sheet in two to a booklet formed by folding 25 sheets in two are illustrated as the booklet formed by the saddle stitch binding portion 800. Among the booklets, the booklets formed by folding 1 to 10 sheets in two are not subject to the squaring process, while the booklets formed by folding 11 to 25 sheets in two are subject to the squaring process. This is because the booklets formed by folding 1 to 10 sheets in two have a small thickness, and the curved portion of the spine is small, so that the sufficient fold that is difficult to secure the deformation amount (pressing amount) for performing the squaring process is formed. Therefore, even if the squaring process is performed, the ease of opening the booklet is unchanged. The booklets formed by folding 11 to 25 sheets in two are subject to the squaring process. When a booklet is formed by folding 11 to 25 sheets in two, the width of the booklet varies, so that the squaring process is performed with the thickness of the booklet classified into plural stages (here, two stages). When the thickness of the booklet is within T2 to T3, the first pressing member 650 having the thickness H2 smaller than the thickness of the booklet S2 is selected to perform the squaring process to the spine of the booklet S2, as illustrated in FIGS. 7C and 7D. On the other hand, when the thickness of the booklet is within T4 to T5, the second pressing member 651 having the thickness H3 smaller than the thickness of the booklet S3 is selected to perform the squaring process to the spine of the booklet S3, as illustrated in FIGS. 7E and 7F. Specifically, the squaring process is performed in such a manner that the pressing member having the thickness closest to the space between the holding surfaces of the upper and lower pressing plates is selected among the pressing members that have the thickness smaller than the space between the holding surfaces (the thickness of the booklet), according to the thickness of the booklet that is held. In this way, the squaring process is performed in such a manner that the pressing member capable of entering the gap between the upper and lower pressing plates 633 and 631 and having the thickness closest to the thickness of the booklet that is nipped and held is selected among the plural pressing members, whereby a smooth surface having an appropriate width according to the thickness of the booklet is formed. Thus, the spine of the booklet can be highly-attractively deformed without forming a pressing mark on the spine of the booklet.

The diameter D1 of each of the stopper members 649*a* and 649*b*, the diameter D2 of the first pressing member 650, and the diameter D3 of the second pressing member 651 have the relationship of D1<D2<D3. The deformation amount (pressing amount) P2 is represented by the equation of P2=(D2−D1)/2, when the first pressing member 650, which is used to perform the squaring process to a relatively thin booklet, is employed. On the other hand, the deformation amount (pressing amount) P3 is represented by the equation of P3=(D3−D1)/2, when the second pressing member 651, which is used to perform the squaring process to a relatively thick booklet, is employed. Specifically, the inequality of (P2<P3) is set in order that the deformation amount (pressing amount) of the thick booklet is greater than that of the thin booklet. In the present embodiment, the deformation amount (pressing amount) to which the squaring process is performed is set not by the positioned location by the stopper member but by the diameter of the pressing member.

The diameter and the deformation amount (pressing amount) of the pressing member correspond to the entering amount of the pressing member to the portion between the holding surfaces of the upper and lower pressing plates 631 and 633. Since the thin booklet and the thick booklet are positioned by the same stopper members 649*a* and 649*b*, the booklet can be positioned at the same location, regardless of the thickness of the booklet. In the case of the thin booklet, the pressing member used for the squaring process has a small thickness and small diameter, while in the case of the thick booklet, the pressing member used for the squaring process has a great thickness and great diameter. This is based on the following. Specifically, the positioned location is set to be the same, regardless of the thickness of the booklet, and the pressing amount of the thick booklet is set to be always greater than that of the thin booklet, whereby the excessive deformation of the spine of the thin booklet and the insufficient deformation of the spine of the thick booklet can be prevented. Therefore, the shape of the booklet that is subject to the squaring process is stabilized.

In the above description, the thickness of the booklet is classified into two cases, and two types of pressing members, each having a different thickness and a different diameter, are used. However, the invention is not limited thereto. For example, the thickness of the booklet may be classified into three, four, or more, and the types of the pressing members to be used may be increased.

In the present embodiment, the holding surfaces of the upper and lower pressing plates 633 and 631 are not in contact with the spine of the booklet before the spine of the booklet is pressed. When the spine of the booklet is pressed by the pressing member, the spine of the booklet, which is not in contact with the holding surfaces of the upper and lower pressing plates 633 and 631, starts to be deformed. However, the space between the holding surfaces, i.e., the deformation exceeding the thickness of the booklet held by the upper and lower pressing plates 633 and 631, is regulated by the holding surfaces of the upper and lower pressing plates 633 and 631. In this case, the holding surfaces of the upper and lower pressing plates 633 and 631 at the deformation amounts P2 and P3 serve as restricting surfaces for restricting the deformation of the spine in the thickness direction of the booklet. As described above, the deforming process is performed within the space between the holding surfaces, whereby deformation of the spine in the thickness direction is restricted, and hence, a stacking property is enhanced.

In the present embodiment, the pressing surfaces of the upper and lower pressing plates 633 and 631 are set as smooth surfaces continuous with the holding surfaces of the upper and lower pressing plates 633 and 631 that are parallel to each other. However, they do not have to be parallel to each other, so long as they can suppress the deformation exceeding the thickness of the booklet. The pressing surfaces do not need to be continuous with the holding surfaces of the upper and lower pressing plates 633 and 631. They may be provided with the use of another member.

Figure 8A:
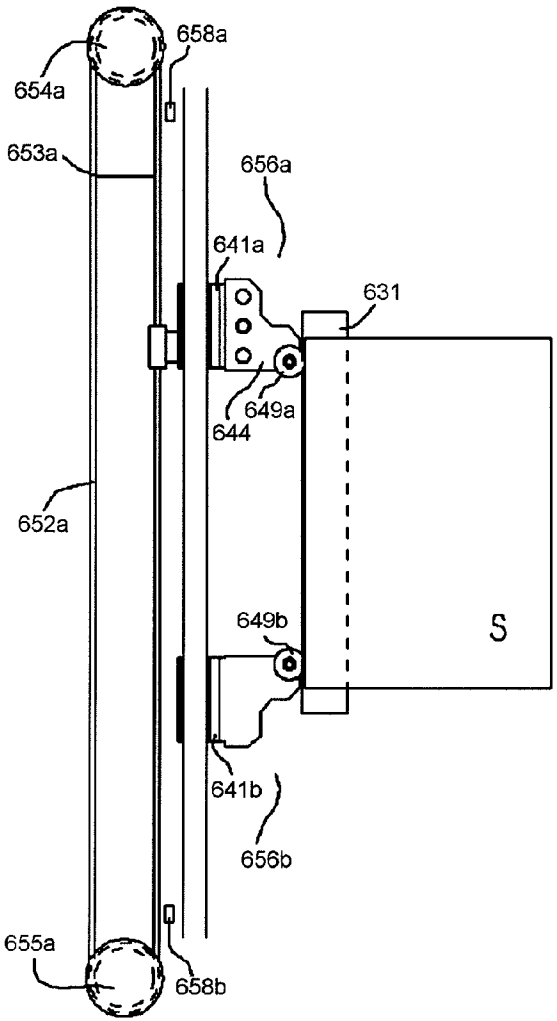
FIGS. 8A and 8B are top views illustrating an operation of the squaring unit.

The stopper members 649*a* and 649*b*, the first pressing member 650, and the second pressing member 651 can make a reciprocating movement in the direction of A in FIG. 5 by the sliding movement of the moving units 656*a* and 656*b* between the holding surfaces of the upper and lower pressing plates 633 and 631 of the pressing unit 630. When the moving unit 656*a* is at the position outside the portion between the holding surfaces of the upper and lower pressing plates 633 and 631 (when the moving unit 656*a* is located at the side of the upper and lower pressing plates 633 and 631), the changeover unit 657 is slid. Thus, the member located between the holding surfaces of the upper and lower pressing plates 633 and 631 can be changed. When the booklet conveyed from the conveying portion 620 is positioned by the pressing unit 630, the stopper members 649*a* and 649*b* are located between the holding surfaces of the upper and lower pressing plates 633 and 631 at the inside from the width of the booklet (FIG. 8A) as being symmetric about the center of the booklet in the width direction. With this, the spine of the booklet is hit and positioned at the predetermined location without protruding toward the downstream side from the portion between the holding surfaces of the upper and lower pressing plates 633 and 631.

In the present embodiment, the spine is positioned at the location where the spine does not protrude from the end portion of the upper and lower pressing plates 633 and 631. However, the present invention is not limited thereto. The effect of the present invention is obtained, if the deforming process is performed, while suppressing the deformation of the thickness direction of the booklet by the pressing surfaces of the upper and lower pressing plates 633 and 631 in order to prevent the deformed spine from projecting from the end portion of the upper and lower pressing plates 633 and 631. Specifically, the spine before the deforming process may be positioned at the location where the spine protrudes from the end portion of the upper and lower pressing plates 633 and 631.

Figure 3:
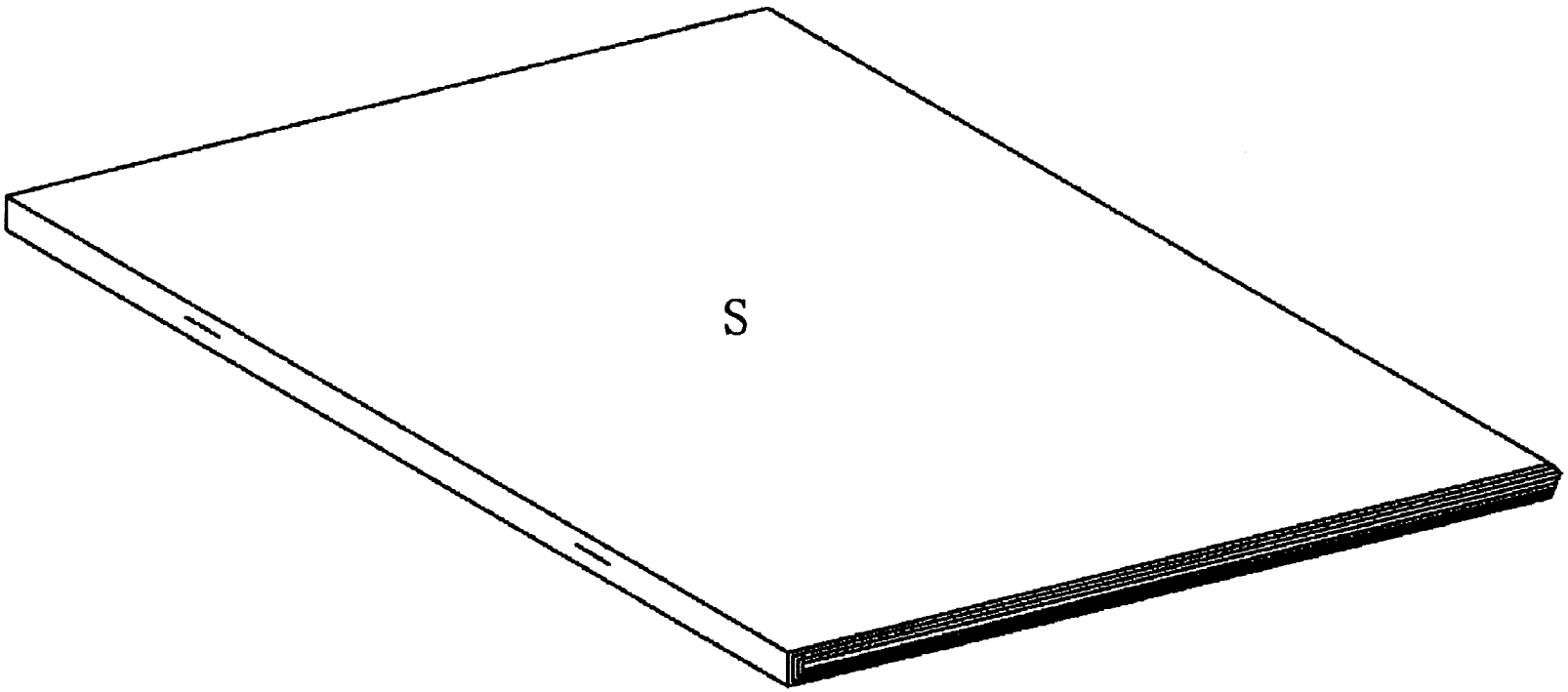
FIG. 3 is a perspective view illustrating a booklet after a squaring process.
Figure 8B:
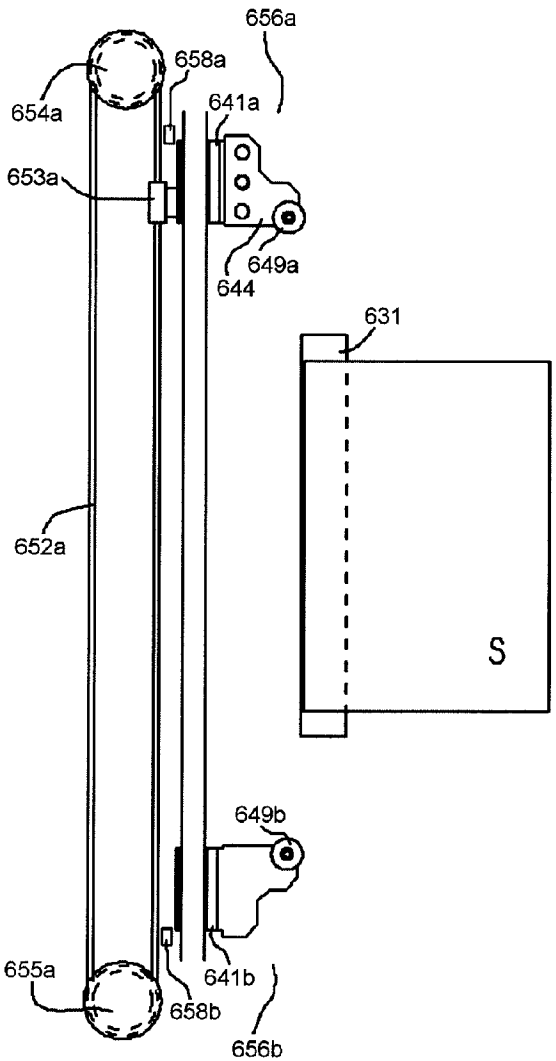
Figure 9A:
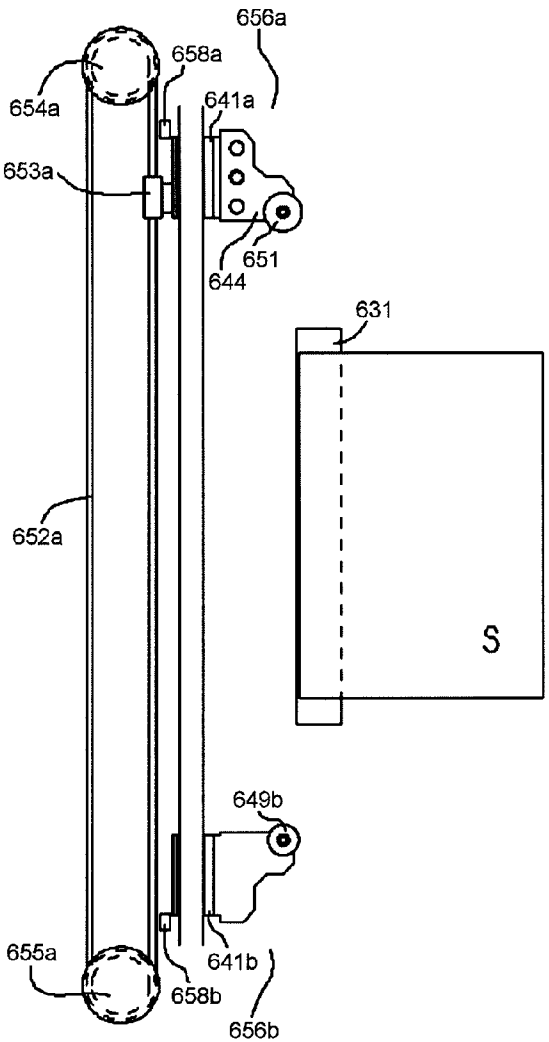
FIGS. 9A and 9B are top views illustrating an operation of the squaring unit.
Figure 9B:
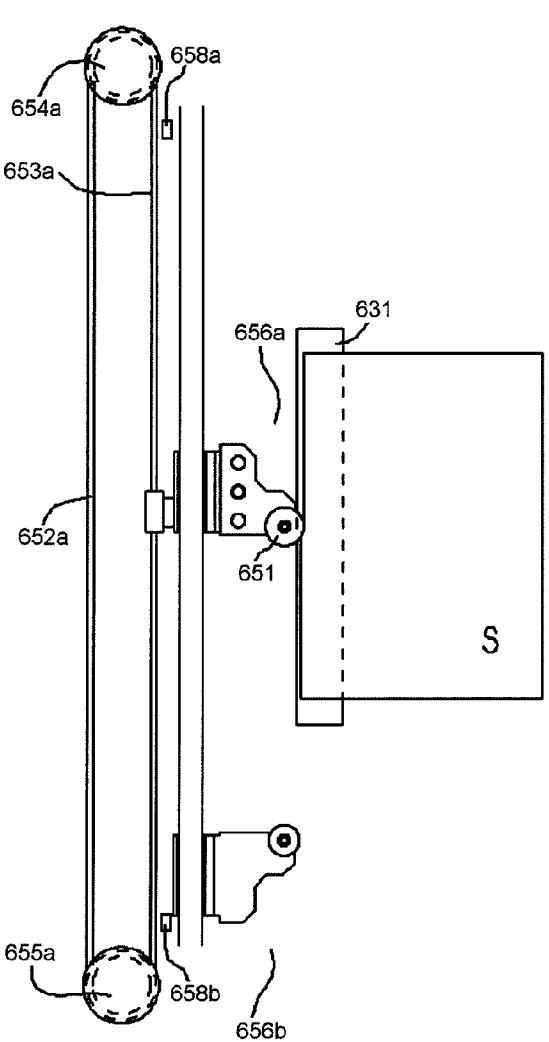
Figure 10A:
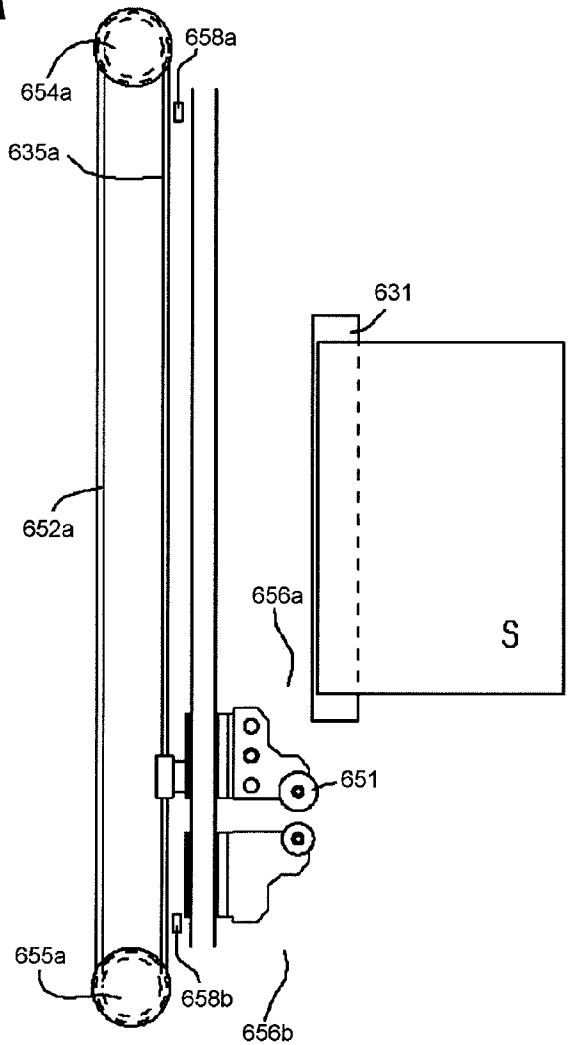
FIGS. 10A and 10B are top views illustrating an operation of the squaring unit.
Figure 10B:
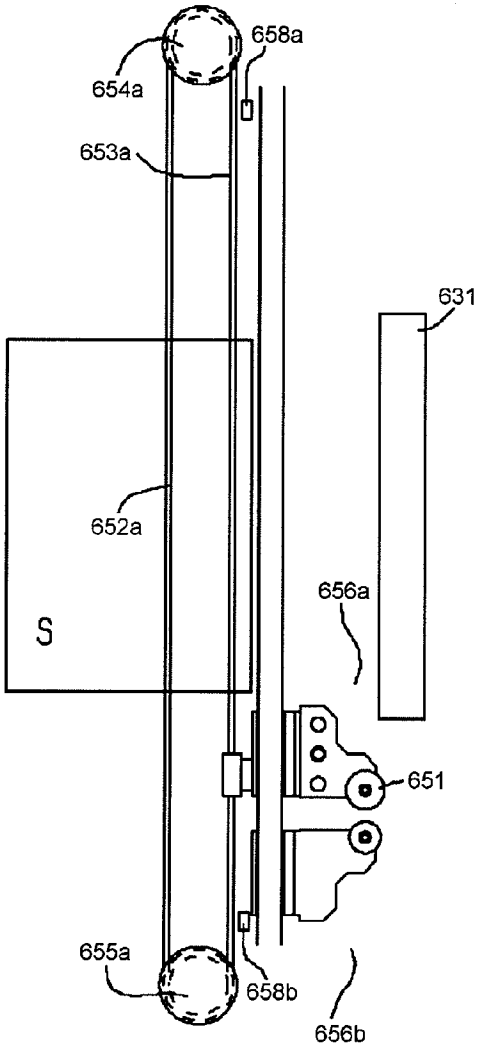

The booklet conveyed to the stopper members 649*a* and 649*b* is detected by the positioning detection sensor 626 (see FIG. 4). As described above, the thickness of each of the stopper members 649*a* and 649*b* is set to be greater than the thickness of the booklet in order that the spine of the thick booklet can be positioned through the abutment against the stopper members. Therefore, when the stopper members 649*a* and 649*b* are located between the upper and lower pressing plates 633 and 631, the upper pressing plate 633 cannot hold the booklet. Accordingly, as illustrated in FIG. 8B, after the stopper members 649*a* and 649*b* are moved to the side of the upper and lower pressing plates 633 and 631 after the booklet is positioned, the vicinity of the spine of the booklet is nipped and held by the pressing unit 630. In this case, the spine of the booklet does not protrude from the end face of the upper and lower pressing plates 633 and 631 at the downstream side in the conveying direction. Since the booklet is nipped and held by the upper and lower conveying belts 622 and 621 of the conveying portion 620, the booklet is prevented from being shifted. Thereafter, the stopper member 649*a* is changed to the first pressing member 650 or the second pressing member 651 by the changeover unit 657 according to the thickness of the booklet detected by the thickness detection sensor 681, as illustrated in FIG. 9A. FIG. 9A illustrates that the member is changed to the second pressing member 651. The moving unit 656*a* is moved to the reverse end of the booklet as illustrated in FIG. 9B and FIG. 10A, whereby the spine of the booklet is pressed to perform the squaring process. The booklet that is subject to the squaring process is conveyed to the downstream side as illustrated in FIG. 10B. FIG. 3 illustrates the booklet having the squared spine.

As illustrated in FIG. 4, in the squaring processing portion 600, the conveying portion 660 includes the lower conveying belt 661 and the upper conveying belt 662 that receive the booklet, which has been subject to the squaring process and which is released from the pressing unit 630 that nips and holds the booklet, and conveys the same to the downstream side. The upper conveying belt 662 can pivot about a supporting point 663 according to a thickness of the booklet. The upper conveying belt 662 is pressed against the lower conveying belt 661 by a spring (not illustrated). The upper and lower conveying belts 661 and 662 are coupled to the conveying portion 620 through the drive-connection, and are driven by the motor SM4.

The conveyer tray 670 has stacked thereon the booklets discharged from the conveying portion 660. A conveyer belt 671 that receives a drive of a motor SM10 to move in the conveying direction is mounted on the lower surface of the conveyer tray 670. The conveyer belt 671 repeats the movement in a predetermined amount every time the booklet is discharged, thereby stacking the booklets. The discharge detection sensor 664 detects the discharge of the booklet from the conveying portion 660.

(Controlling Portion)

Figure 11:
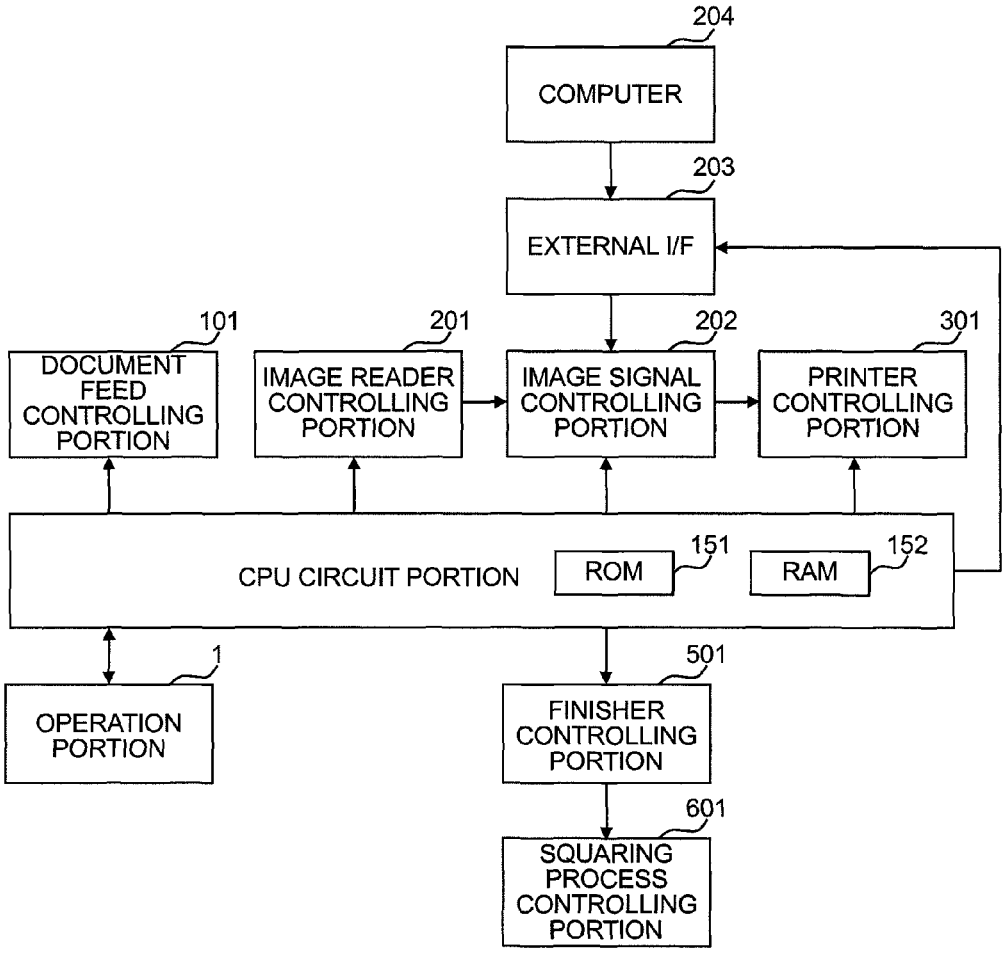
FIG. 11 is a block diagram illustrating a control system of an image forming system.

A control system of the image forming system will be described here with reference to FIG. 11. FIG. 11 is a block diagram illustrating the control system of the image forming system 1000. A CPU circuit portion 150 has a CPU (not illustrated), a ROM 151, and a RAM 152. The controlling portion controls the document feed controlling portion 101, the image reader controlling portion 201, the image signal controlling portion 202, the printer controlling portion 301, the finisher controlling portion 501, and the external I/F 203 according to the control program stored in the ROM 151 and the setting by the operation portion 1. The document feed controlling portion 101 controls the document feed portion 100, the image reader controlling portion 201 controls the image reader 200, and the printer controlling portion 301 controls the printer 300. The finisher controlling portion 501 controls the finisher 500 and the saddle stitch binding portion 800, and the squaring processing portion 601 controls the squaring processing portion 600 based on the instruction from the finisher controlling portion 501.

The operation portion 1 has plural keys for setting various functions relating to the image formation, and a display portion for displaying the set state. The operation portion 1 outputs a key signal corresponding to the operation of each key by a user to the CPU circuit portion 150, and displays the corresponding information to the display portion based on the signal from the CPU circuit portion 150.

The RAM 152 is used as an area for temporarily retaining the control data or as a working area for computation involved with the control. The external I/F (external interface) 203 is an interface between the image forming system 1000 and an external computer 204. It expands the print data from the computer 204 into a bit-mapped image, and outputs the resultant to the image signal controlling portion 202 as image data. The image reader controlling portion 201 outputs the image of the document read by the image sensor 109 to the image signal controlling portion 202. The printer controlling portion 301 outputs the image data from the image signal controlling portion 202 to the exposure controlling portion 110.

Figure 12:
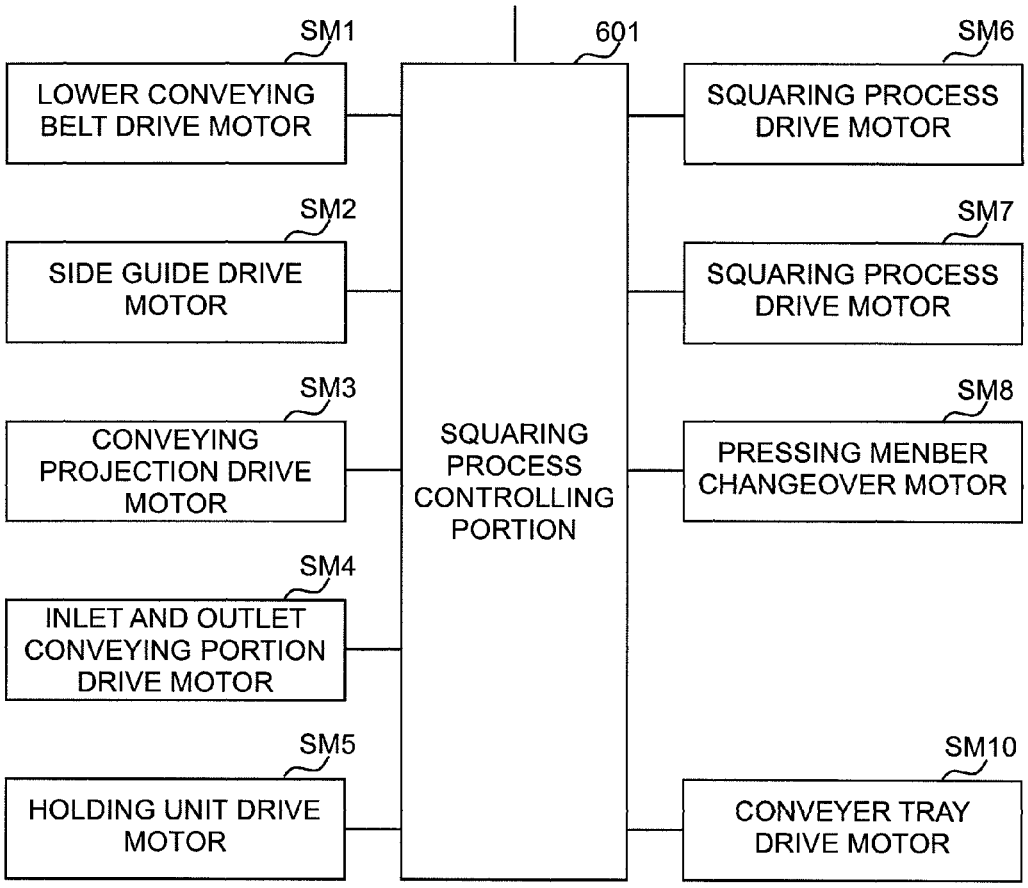
FIG. 12 is a block diagram illustrating a control system of the squaring unit.

FIG. 12 is a block diagram of the squaring process controlling portion 601. The squaring process controlling portion 601 controls the respective drive motors SM1, SM2, SM3, SM4, SM5, SM6, SM7, SM8, and SM10.

(Operation of Squaring Process)

The operation of the squaring (deformation) process at the squaring processing portion 600 will be described based on the configuration described above. The operations of the respective portions will be described together with the movement of the booklet.

When a saddle-stitching mode is selected by the operation portion 1, it can be selected whether the squaring process mode is set or not.

When the squaring process mode is not selected, the saddle-stitched booklet created at the saddle stitch binding portion 800 is discharged onto the conveyer tray 670 by the lower conveying belt 611, the conveying projection 613, the conveying portion 620, and the conveying portion 660. In this case, the pair of side guides 612, the upper pressing plate 633, and moving units 656*a* and 656*b* are retracted at the position where they do not block the conveying path.

Figure 13:
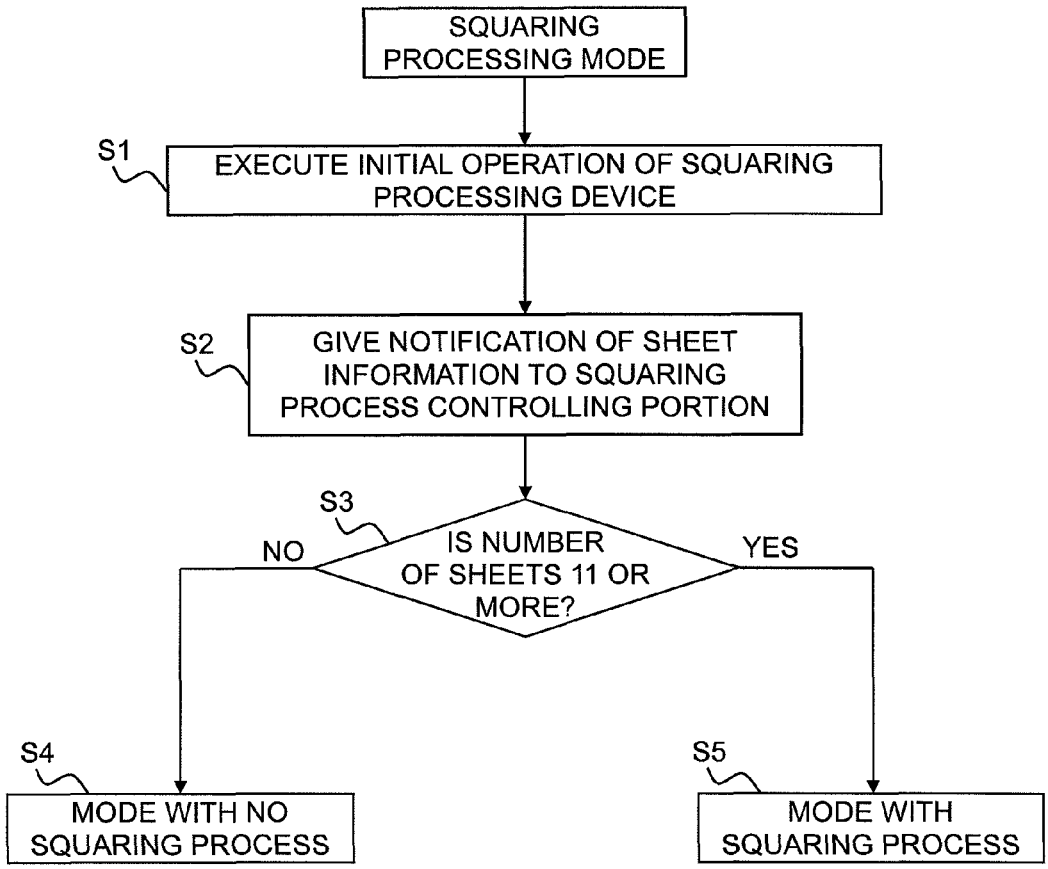
FIG. 13 is a flowchart illustrating a flow of an operation of a squaring process mode.
Figure 14:
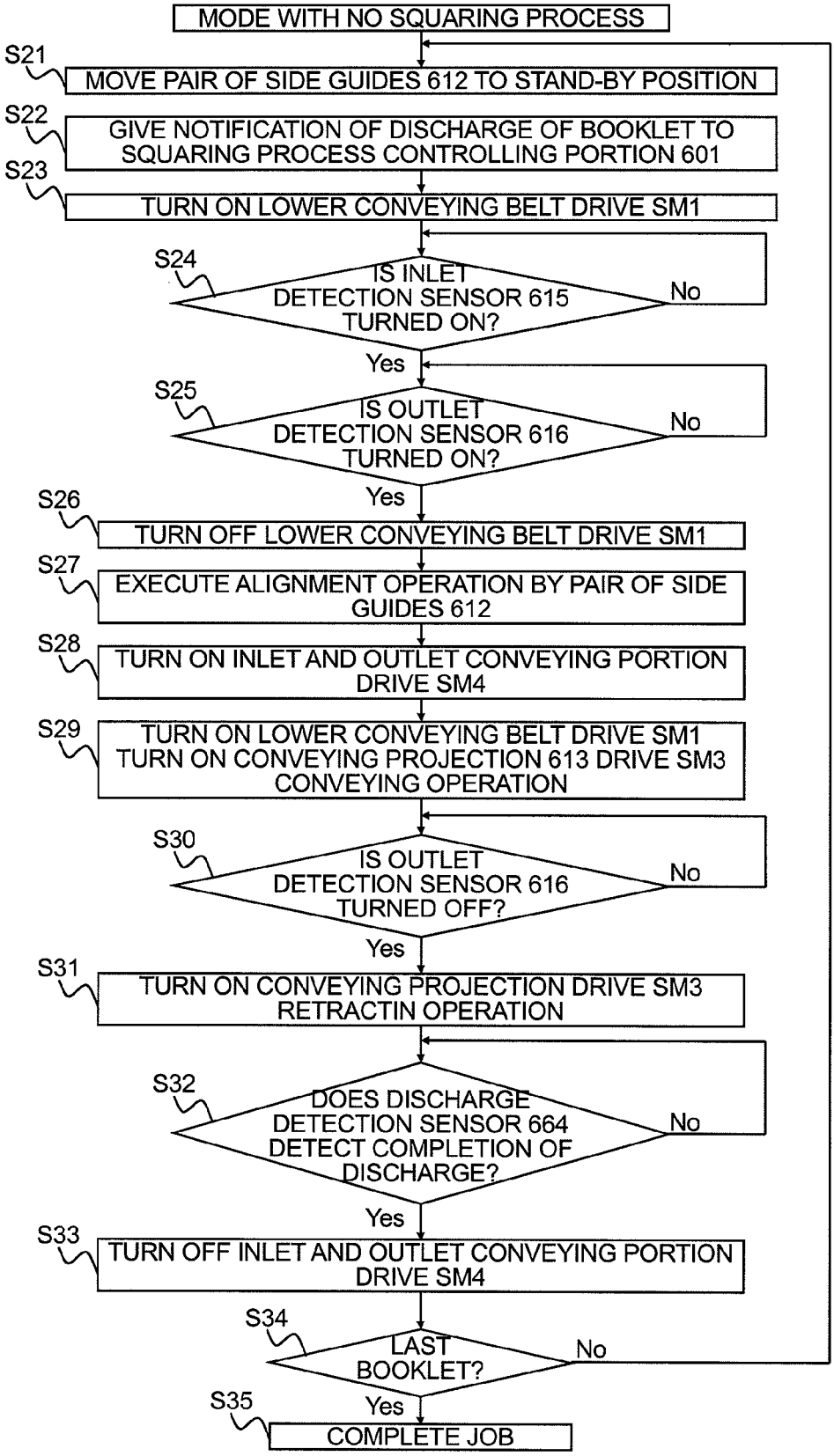
FIG. 14 is a flowchart illustrating a flow of an operation of a mode with no squaring process.
Figure 15:
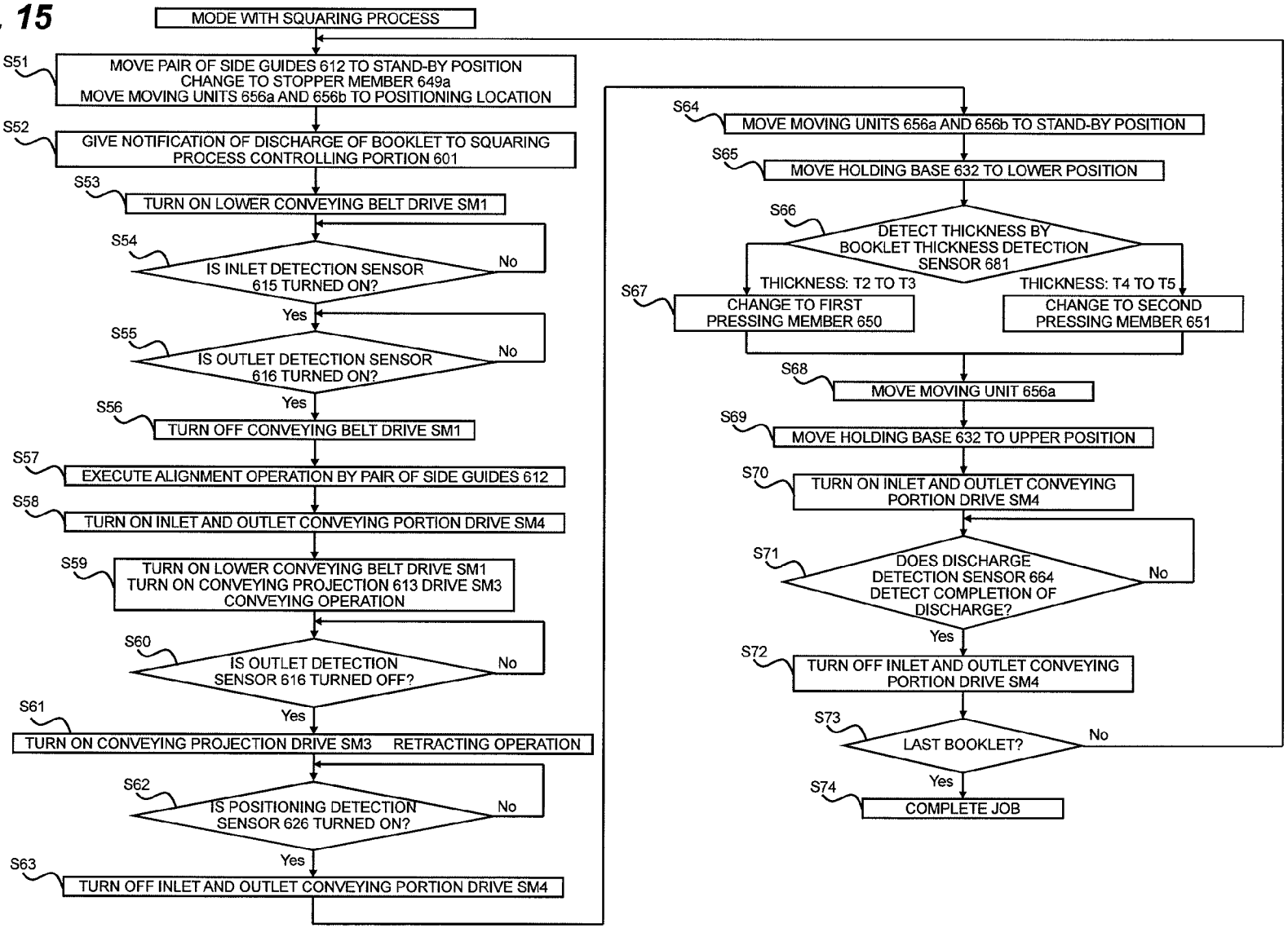
FIG. 15 is a flowchart illustrating a flow of an operation of a mode with a squaring process.

The operation when the squaring process mode is selected will be described below in detail. FIGS. 13, 14, and 15 are flowcharts illustrating the flow of the operation when the squaring process mode is selected.

When the squaring process mode is selected, the squaring processing portion 600 performs an initial operation (S1) as illustrated in FIG. 13. When the booklet is made at the saddle stitch binding portion 800, the number of sheets of the booklet, the size of the sheet, and the number of booklets to be formed are reported to the squaring process controlling portion 601 (S2) before the booklet is discharged to the receiving portion 610 of the squaring processing portion 600 by the pair of second fold conveying rollers 812. The squaring process controlling portion 601 determines whether the number of sheets of the booklet S is 11 or more (S3). When the reported number of sheets of the booklet is 10 or less (NO), the squaring process controlling portion 601 selects the mode with no squaring process (S4), while when it is 11 or more (YES), the squaring process controlling portion 601 selects the mode with the squaring process (S5).

When the number of the sheets of the booklet is 10 or less, and the mode with no squaring process is selected, the flow in FIG. 14 is executed.

The pair of side guides 612 arranged at both sides of the conveying path of the receiving portion 610 moves at the stand-by position according to the size of the booklet (S21). When receiving the notification of the discharge from the saddle stitch binding portion 800 (S22), the lower conveying belt 611 is rotated by the drive motor SM1 (S23) to convey the booklet. After the inlet detection sensor 615 and the outlet detection sensor 616 detect the booklet (S24, S25), the conveyance of the booklet is temporarily stopped (S26). Thereafter, the pair of side guides 612 performs an alignment operation by the drive motor SM12 (S27). Then, the drive motor SM4 drives the conveying portion 620 and the conveying portion 660 (S28), whereby the conveyance of the booklet is restarted by the conveying projection 613 and the lower conveying belt 611 arranged at the upstream side of the receiving portion 610 (S29). The conveying projection 613 is driven by the drive motor SM13. When the outlet detection sensor 616 detects the discharge of the booklet (S30), the conveying projection 613 is retracted toward the upstream side in the conveying direction (S31). When the booklet conveyed by the conveying portion 620 and the conveying portion 660 is discharged to the conveyer tray 670 and the discharge detection sensor 664 detects the discharge (S32), the conveying portion 620 and the conveying portion 660 stop (S33). The booklet discharged onto the conveyer tray 670 is stacked one by one in an imbricated state. When the discharged booklet is not the last one, the processing returns to S21, and when the discharged booklet is the last one, the job is completed (S34, S35).

On the other hand, when the number of the sheets of the booklet is 11 or more, and the mode with the squaring process mode is selected, the flow in FIG. 15 is executed.

The pair of side guides 612 arranged at both sides of the conveying path of the receiving portion 610 moves to the stand-by position according to the size of the booklet. With this, the member is changed to the stopper member 649*a* by the changeover unit 657, whereby the moving units 656*a* and 656*b* move to the positioning location (S51). The positioning location is changed according to the size of the booklet. The positioning location is set to the position where the spine of the booklet does not rotate when it hits the stopper members 649*a* and 649*b* and the parallel state of the spine of the booklet is maintained with respect to the moving direction of the moving units 656*a* and 656*b*. When receiving the discharge notification from the saddle stitch binding portion 800 (S52), the lower conveying belt 611 is rotated by the drive motor SM1 (S53) to convey the booklet. After the inlet detection sensor 615 and the outlet detection sensor 616 detect the booklet (S54, S55), the conveyance of the booklet is temporarily stopped (S56).

Figure 16:
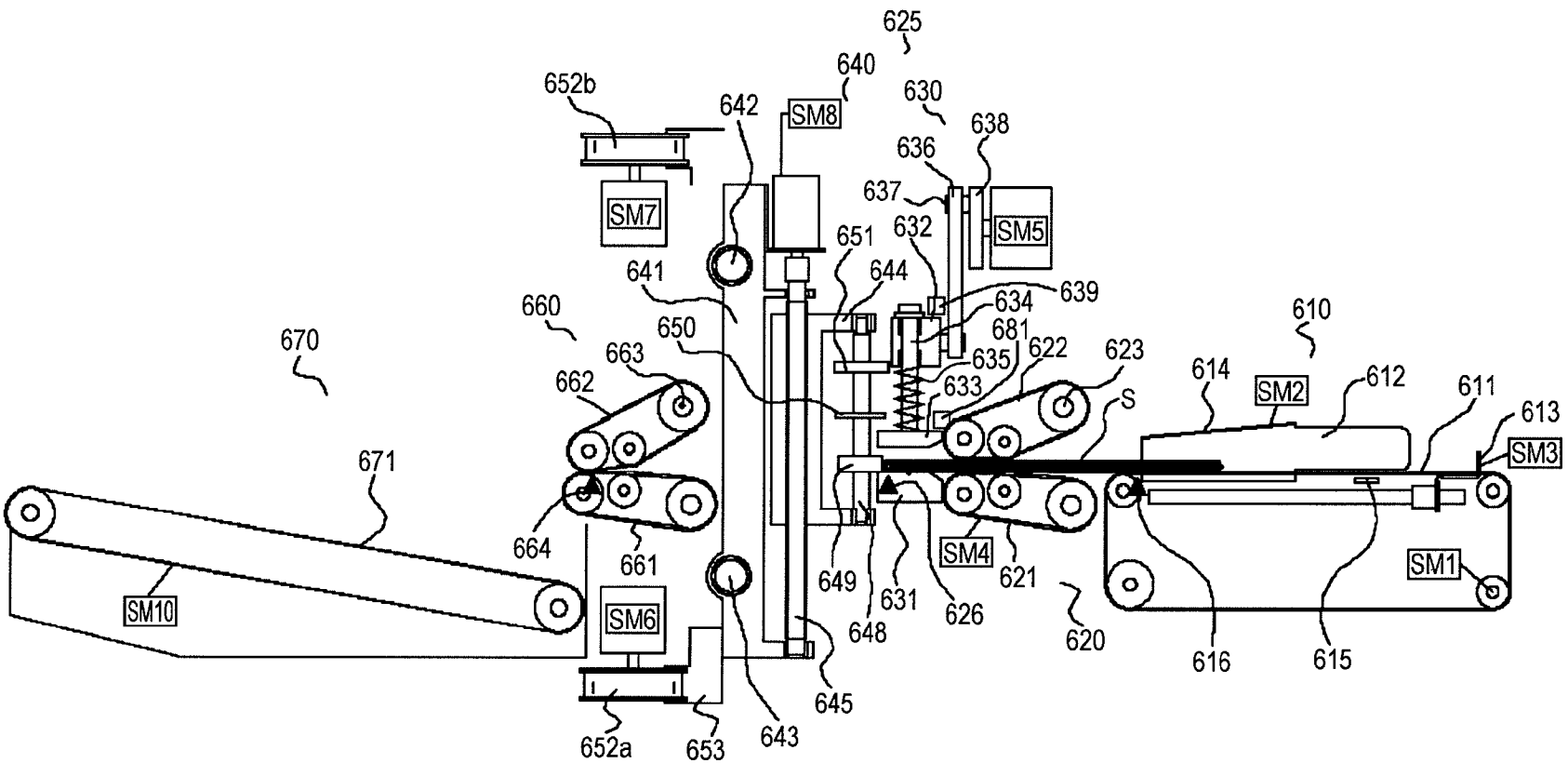
FIG. 16 is a top view illustrating an operation of the squaring unit.

Thereafter, the pair of side guides 612 performs an alignment operation by the drive motor SM12 (S57). Then, the drive motor SM4 drives the conveying portion 620 and the conveying portion 660 (S58), whereby the conveyance of the booklet is restarted by the conveying projection 613 and the lower conveying belt 611 arranged at the upstream side of the receiving portion 610 (S59). The conveying projection 613 is driven by the drive motor SM13. When the outlet detection sensor 616 detects the discharge of the booklet (S60), the conveying projection 613 is retracted toward the upstream side in the conveying direction (S61). When the booklet conveyed by the conveying portion 620 is detected by the positioning detection sensor 626 (S62), the conveying portion 620 stops (S63). In this case, the booklet is positioned at the location where the spine of the booklet hits the stopper members 649*a* and 649*b*, and the spine of the booklet does not project from the lower end between the holding surfaces of the upper and lower pressing plates 633 and 631 in the conveying direction, as illustrated in FIG. 16.

Figure 17:
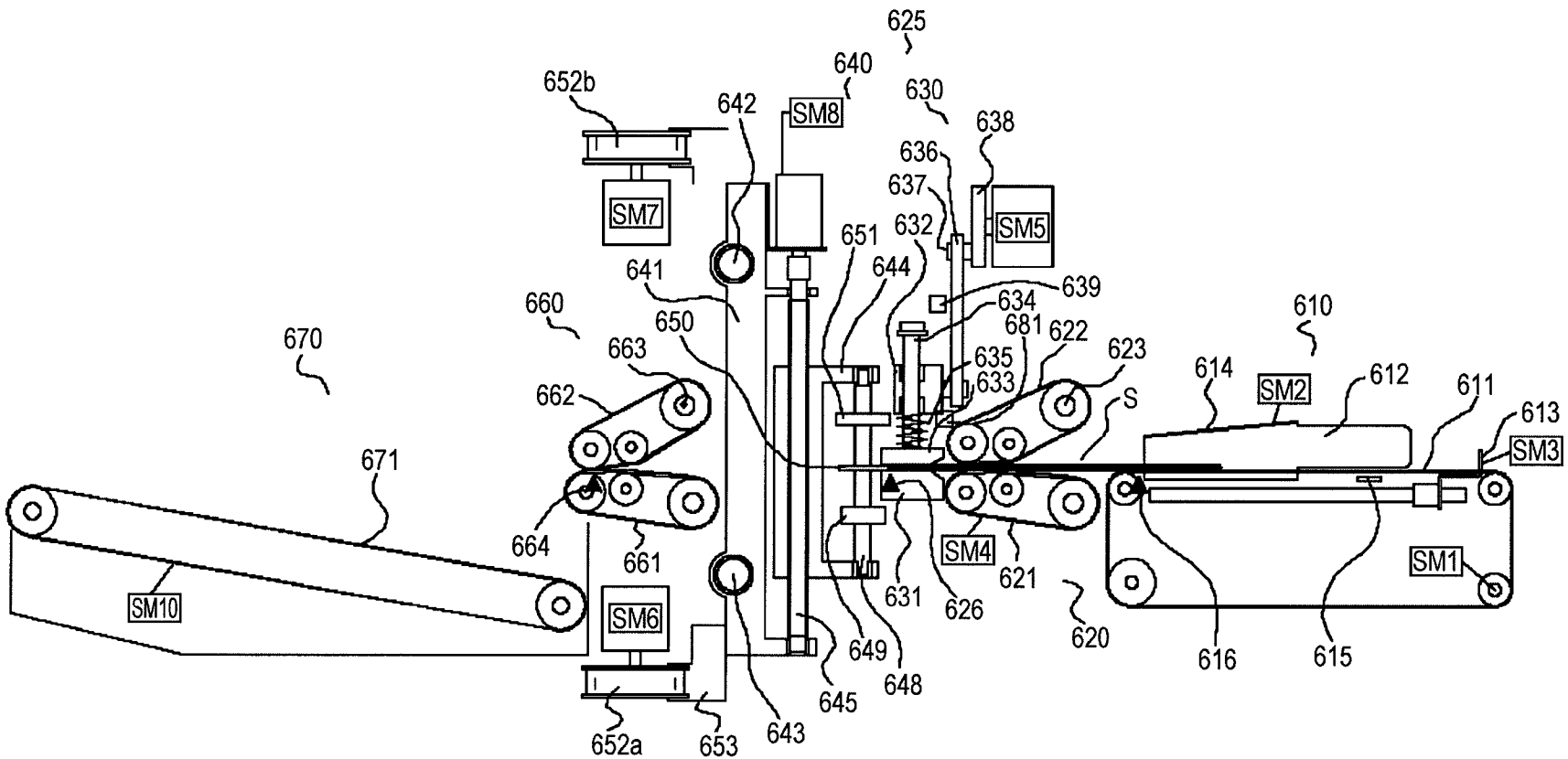
FIG. 17 is a top view illustrating an operation of the squaring unit.
Figure 18:
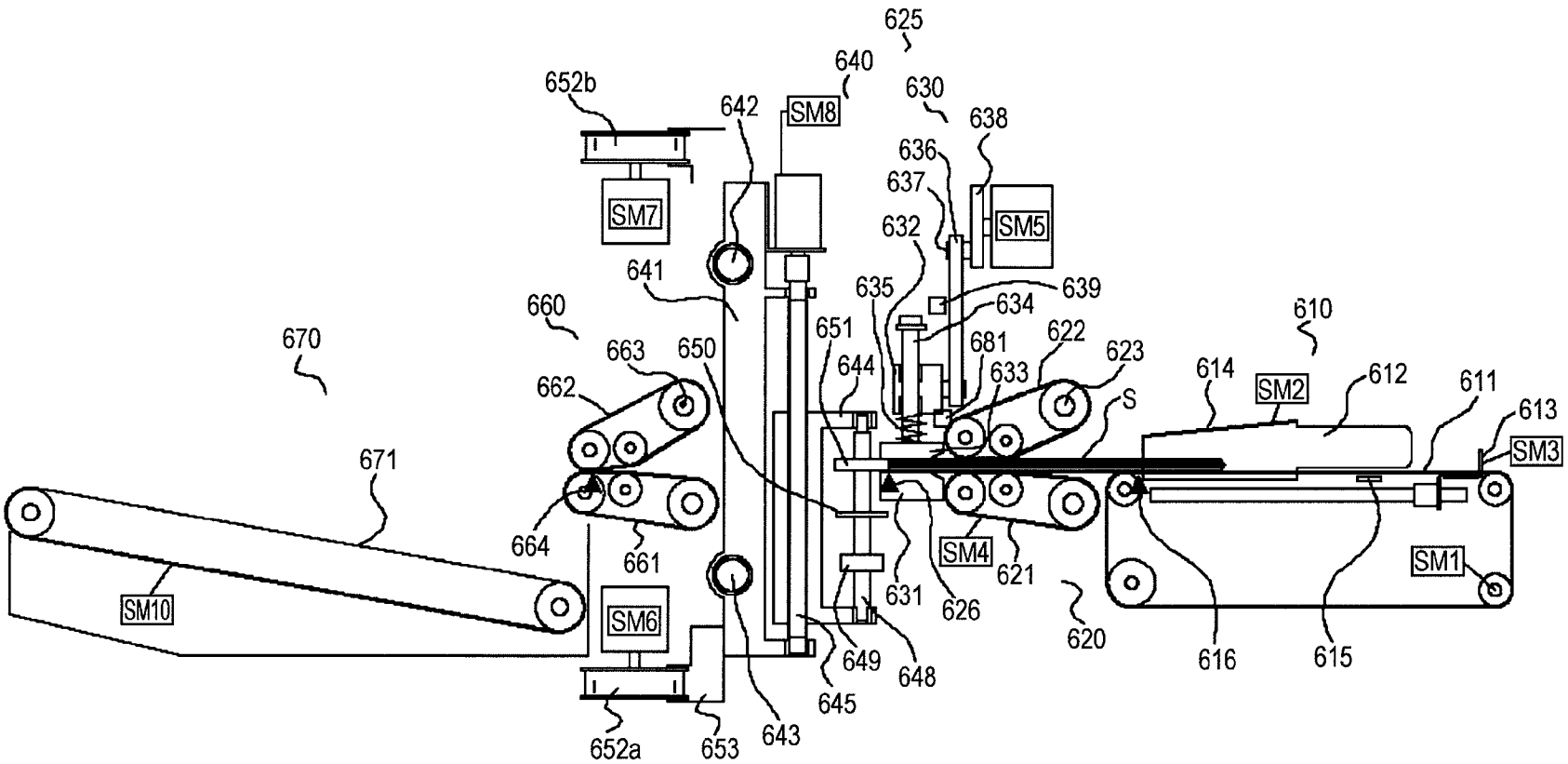
FIG. 18 is a top view illustrating an operation of the squaring unit.
Figure 19E:
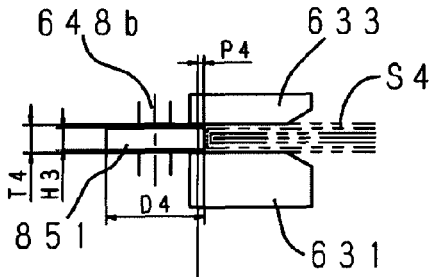
FIGS. 19A to 19F are enlarged views of essential parts illustrating the relationship between the space between holding surfaces of pressing plates and each member according to a second embodiment of the present invention.
Figure 19F:
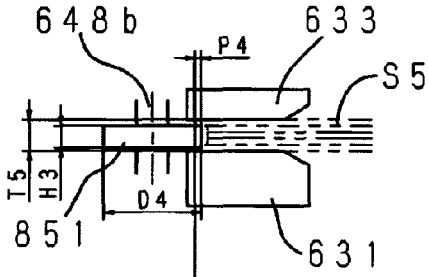
Figure 19C:
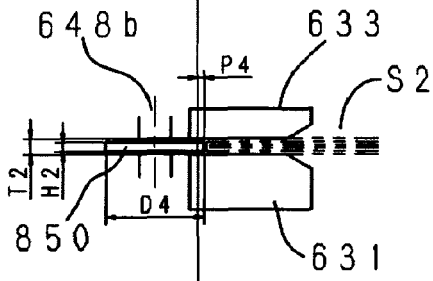
Figure 19D:
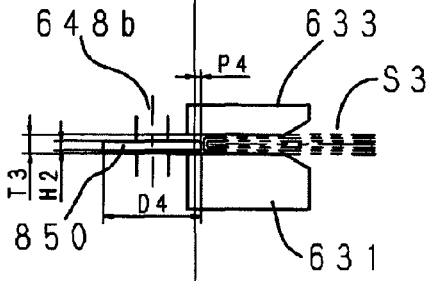
Figure 19A:
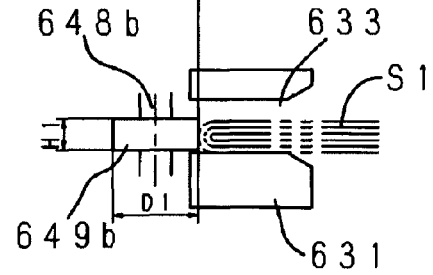
Figure 19B:
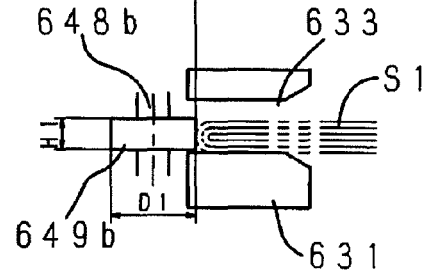

Then, the moving units 656*a* and 656*b* move to the stand-by position that is outside the portion between the holding surfaces of the upper and lower pressing plates 633 and 631 (the position at the side of the upper and lower pressing plates 633 and 631) (S64). The drive motor SM5 moves the pressing base 632 to the lower position (S65), whereby the spine of the booklet is fixed by the opposing holding surfaces of the upper and lower pressing plates 633 and 631. Next, the thickness detection sensor 681 detects the position of the upper pressing plate 633, which fixes the booklet (S66), whereby the thickness of the booklet is measured. When the thickness of the booklet is within the above-mentioned range of T2 to T3, the pressing member is changed to the first pressing member 650, while when the thickness of the booklet is within the range of T4 to T5, the pressing member is changed to the second pressing member 651 (S67). Then, the moving unit 656*a* is moved along the spine of the booklet (S68), whereby the squaring process is performed to the spine of the booklet. FIG. 17 is a view illustrating that the squaring process is performed to the spine of the booklet S by the first pressing member 650. FIG. 18 is a view illustrating that the squaring process is performed to the spine of the booklet S by the second pressing member 651.

As described above, since the spine of the booklet is nipped and held by the inner sides (between the holding surfaces) of the upper and lower pressing plates 633 and 631, it is prevented that the spine is brought into contact with the end face (corner portion) of the upper and lower pressing plates 633 and 631 when the spine is crushed to perform the squaring process, resulting in that a pressing mark is not formed.

Further, since the spine of the booklet is enclosed by the upper and lower pressing plates 633 and 631 and the first pressing member 650 or the second pressing member 651, extra pressing force is not applied, resulting in that a smooth surface having a width substantially equal to the thickness of the booklet is formed. The action that deforms even the sheet spine at the center of the booklet is not exerted, whereby a good-looking booklet can be formed in which the spine is squared successively from the inside.

After the movement of the moving unit 656*a* is completed, the pressing base 632 moves to the upper position (S69), and the upper and lower pressing plates 633 and 631 are separated from each other, whereby the booklet that is pressed and held by the opposing holding surfaces is released. The drive motor SM4 drives the conveying portion 620 and the conveying portion 660 (S70), so that the booklet is discharged to the conveyer tray 670. When the discharge detection sensor 664 detects the discharge of the booklet (S71), the conveying portion 620 and the conveying portion 660 stop (S72). The booklet discharged onto the conveyer tray 670 is stacked one by one in an imbricated state. When the discharged booklet is not the last one, the processing returns to S51, and when the discharged booklet is the last one, the job is completed (S73, S74).

Second Embodiment

In the first embodiment, the squaring (deforming) process is performed by changing pressing members, each having a different thickness and a different diameter, according to a thickness of a booklet. In a second embodiment, pressing members, each having a different thickness but same diameter, are used according to a thickness of a booklet. In the second embodiment, the portions same as those in the first embodiment are identified by the same numerals, and the description will not be repeated. FIGS. 19A to 19F are enlarged views of essential parts illustrating the relationship between the space between holding surfaces of a pair of holding members and each member according to the second embodiment of the present invention.

As illustrated in FIG. 19, a pressing member 850 has a thickness H2 and a diameter D4, and a pressing member 851 has a thickness H3 and a diameter D4, which means they are different from each other in thickness, but same as the diameter. In the present embodiment, when the thickness of the booklet is within T2 to T3, the squaring process is performed by using the pressing member 850, while when the thickness of the booklet is within T4 to T5, the squaring process is performed by using the pressing member 851. The deformation amounts (pressing amounts) in the respective cases are both P4. As described above, the deformation amounts (pressing amounts) are the same, regardless of the thickness of the booklet. Therefore, there is no difference in size from a spine to a fore-edge of a completed booklet. When the thickness of the booklet that can be subject to the squaring process is set to be smaller compared to the first embodiment, there is no need to care about the excessive deformation of the spine of the thin booklet and the insufficient deformation of the spine of the thick booklet. Therefore, a uniform deformation amount (pressing amount) can be set.

In the above description, the thickness of the booklet is classified into two cases, and two types of pressing members, each having a different thickness, are used. However, the invention is not limited thereto. As in the first embodiment, the thickness of the booklet may be classified into three, four, or more, and the types of the pressing members to be used may be increased.

Third Embodiment

Figure 20A:
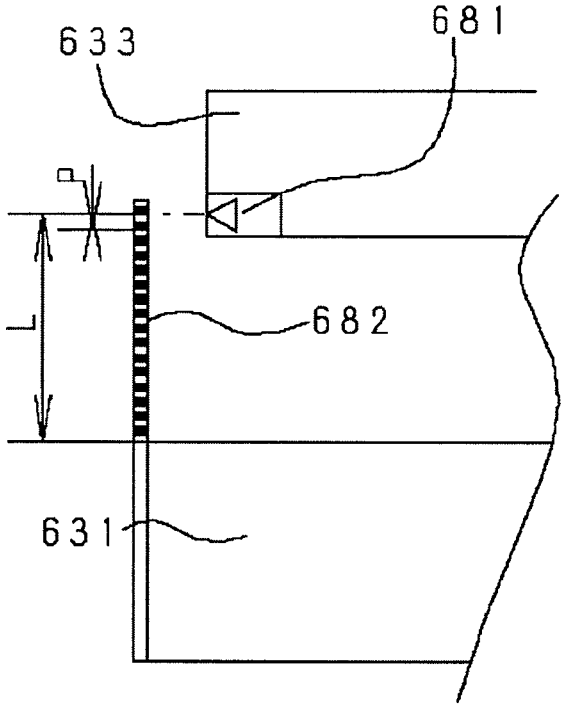
FIGS. 20A and 20B are sectional views illustrating an essential part of an example of a configuration for detecting a thickness of a booklet according to a third embodiment of the present invention.
Figure 20B:
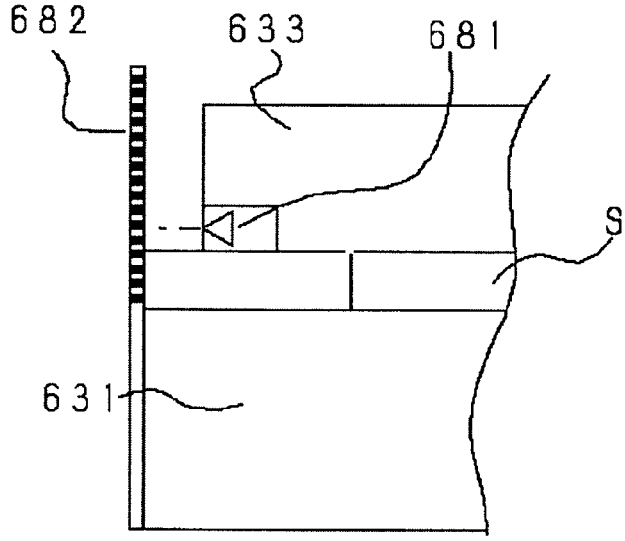
Figure 21A:
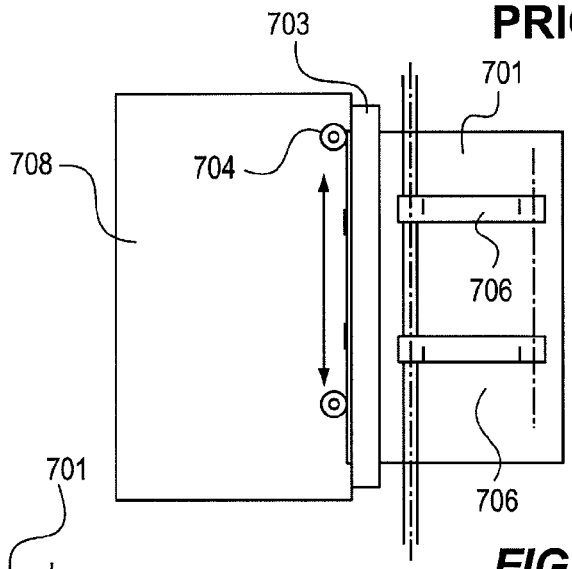
FIG. 21A PRIOR ART
FIGS. 21A to 21F are explanatory views of a conventional technique.
Figure 21E:
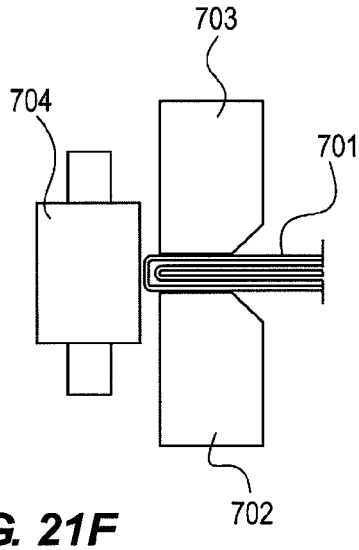
FIG. 21E PRIOR ART
Figure 21B:
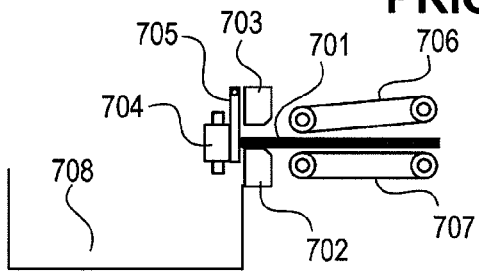
FIG. 21B PRIOR ART
Figure 21F:
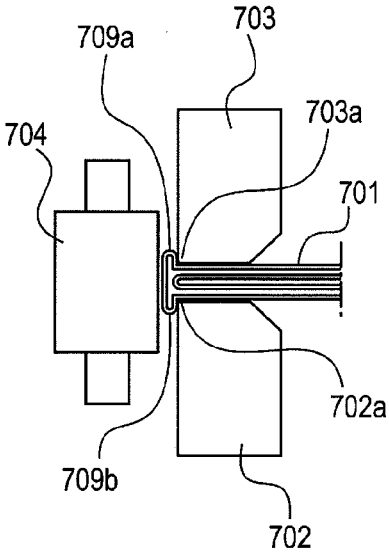
FIG. 21F PRIOR ART
Figure 21C:
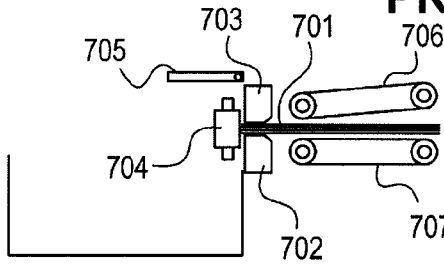
FIG. 21C PRIOR ART
Figure 21D:
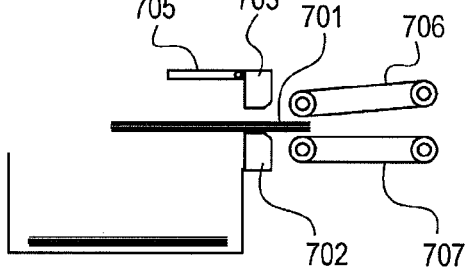
FIG. 21D PRIOR ART
Figure 22:
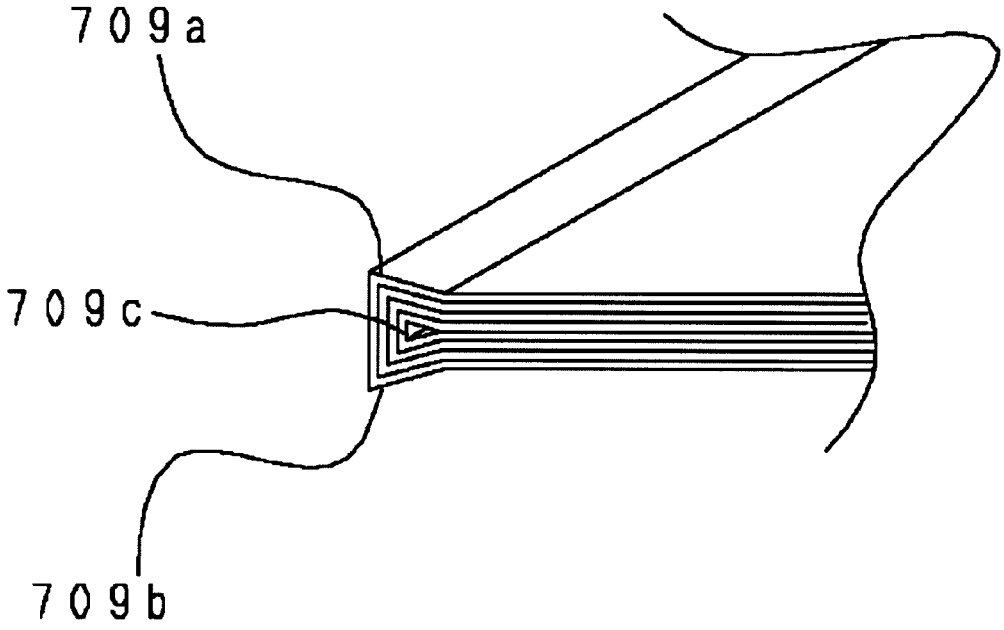
FIG. 22 PRIOR ART
FIG. 22 is an explanatory view of a conventional technique.

In the above-mentioned embodiment, the thickness detection sensor 681 for detecting the thickness of the booklet is a distance-measuring sensor that converts a reflected light quantity into a current value so as to measure a distance, as illustrated in FIG. 4B. However, the thickness detection sensor may be a detection portion illustrated in FIG. 20. FIG. 20A illustrates an example of a configuration for detecting a thickness of a booklet in a third embodiment of the present invention. FIG. 20A is a sectional view of an essential part illustrating the state in which the upper and lower pressing plates 633 and 631 are separated from each other to release the booklet that is nipped and held by the upper and lower pressing plates. FIG. 20B is a sectional view of an essential part illustrating the state in which the upper and lower pressing plates 633 and 631 nip and hold the booklet.

In FIG. 20, the thickness detection sensor 681 is a reflective sensor, and is provided at one end of the upper pressing plate 633. A slit plate 682 extending from the lower pressing plate 631 is fixed to the position opposite to the thickness detection sensor 681. The slit plate 682 is provided with slits equally spaced in the direction of lifting and lowering the upper pressing plate 633. The thickness detection sensor 681 repeats ON and OFF with the lifting and lowering movement of the upper pressing plate 633. The cycle from ON to the next ON, or the cycle from OFF to the next OFF is counted as one pulse, so that the distance between the upper pressing plate 633 and the lower pressing plate 631 can be detected.

For example, when the pressing base 632 is at the upper position detected by the top dead center detection sensor 639, the distance between the upper and lower pressing plates is defined as L. The pulse number by the time when the upper pressing plate lowers to hold the booklet S is defined as N. When the distance of one pulse is defined as P, the thickness T of the booklet S is represented by the equation of $T=L-N\times P$. In this way, the thickness T of the booklet S is detected, and based on this information, the changeover process of the pressing members is performed.

Other Embodiment

In the above-mentioned embodiments, the sensor is used to detect the thickness of the booklet. However, the thickness of the booklet may be calculated without using the sensor, and the operation may be controlled based on the calculated value (thickness of the booklet). In this case, the information (e.g., basis weight) of the sheet accommodated in the cassettes 114 and 115, and the manual feed portion 125 is input to the operation portion (input portion) 1, and stored in the RAM 152. The input basis weight (52 g/m$^2$ to 200 g/m$^2$) is divided into plural categories, and a thickness M per one sheet is allocated for each category based on the actually measured value. The number of sheets N for one sheet bundle is determined by the number of images, and the CPU circuit portion 150 multiplies the number of sheets N and the thickness M of the sheet to calculate the thickness of the sheet bundle. The saddle-stitched booklet is made by folding the sheet bundle in two, which means that it has a thickness double the thickness M of the sheet bundle. As described above, the thickness of the booklet is calculated based on the information of the sheet forming the booklet, and based on this information, the changeover process of the pressing member is performed. In this case, step S66 in FIG. 15 is replaced by "calculation of thickness of booklet by CPU circuit portion 150".

In the above-mentioned embodiment, a booklet formed by folding a single sheet to a booklet formed by folding 25 sheets in two are illustrated as the booklet formed by the saddle stitch binding portion 800. However, the number of sheets may be changed according to the capability of the saddle stitch binding portion 800. In the above description, the booklet that is subject to the squaring process has 11 or more folded sheets in two. However, the number of sheets of the booklet may be changed according to the basis weight or thickness of the media (sheet), and this does not limit the present invention.

In the above-mentioned embodiment, two cases are set according to the thickness of the booklet that is to be subject to the squaring process, and the squaring process is performed by using two types of pressing members, each having a different thickness and a different diameter. However, the present invention is not limited thereto. For example, more cases may be set, and the types of the pressing members to be used may be increased. This does not limit the present invention.

In the above-mentioned embodiment, the cases are classified by detecting the thickness of the booklet by the sensor. However, the cases are classified according to the condition that can determine the thickness of the booklet, such as the basis weight of the media (sheet), thickness, and number of sheets.

In the above-mentioned embodiment, a copying machine is illustrated as the image forming apparatus. However, the present invention is not limited thereto. For example, the image forming apparatus may be other image forming apparatuses such as a printer or facsimile device, or other image forming apparatuses such as a multifunction periphery having these functions combined. When the present invention is applied to the sheet processing apparatus used in the image forming apparatus described above, the same effect can be obtained.

In the above-mentioned embodiment, the sheet processing apparatus that is detachably attachable to the image forming apparatus is illustrated. However, the present invention is not limited thereto. For example, the sheet processing apparatus may be integrally included into the image forming apparatus main body. By applying the present invention to such a sheet processing apparatus, similar effects can be obtained.

According to the present invention, a smooth surface having an appropriate width according to the thickness of a booklet is formed. Therefore, a spine of the booklet can be highly-attractively deformed without forming a pressing mark on the spine of the booklet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-233000, filed Oct. 7, 2009, which is hereby incorporated by reference herein in its entirety.

What is claimed is:

1. A sheet processing apparatus comprising:

a holding portion that nips and holds a booklet, which includes folded sheets, by a pair of holding members opposite to each other; and a pressing portion that enters a gap between the pair of holding members, wherein the pressing portion presses the spine of the held booklet so as to deform the spine of the booklet, wherein the pressing portion has a plurality of pressing members, each having a different thickness in a thickness direction of the booklet, and a selected pressing member among the plurality of pressing members, which is capable of entering the gap between the pair of holding members and which has a thickness closest to a thickness of the booklet which is nipped and held by the pair of holding members, is selected so as to perform the deforming of the spine of the booklet.

2. The sheet processing apparatus according to claim 1, further comprising:

a thickness detection portion that detects the thickness of the booklet, wherein the selected pressing member is selected according to the thickness of the booklet detected by the thickness detection portion.

3. The sheet processing apparatus according to claim 2, wherein the thickness detection portion detects the thickness of the booklet, which is nipped and held by the pair of holding members, by measuring the space between the pair of the holding members.

4. The sheet processing apparatus according to claim 1, further comprising:

a positioning portion that positions the spine of the booklet to a predetermined location, wherein the pressing portion presses the spine of the booklet positioned by the positioning portion.

5. The sheet processing apparatus according to claim 4, wherein the positioning portion has an entering amount to the gap between the holding portions smaller than that of the pressing portion.

6. An image forming apparatus comprising:

an image forming portion that forms an image on a sheet; and a sheet processing portion which selectively performs a process on the sheet having an image formed thereon, wherein the sheet processing portion includes:

a holding portion that nips and holds a booklet, which includes folded sheets, by a pair of holding members opposite to each other; and a pressing portion that enters a gap between the pair of holding members, wherein the pressing portion presses the spine of the held booklet so as to deform the spine of the booket, wherein the pressing portion has a plurality of pressing members, each having a different thickness in a thickness direction of the booklet, and a selected pressing member among the plurality of pressing members, which is capable of entering the gap between the pair of holding members and which has a thickness closest to a thickness of the booklet which is nipped and held by the pair of holding members, is selected so as to perform the deforming of the spine of the booklet.

7. The image forming apparatus according to claim 6, further comprising:

a thickness detection portion that detects the thickness of the booklet, wherein the selected pressing member is selected according to the thickness of the booklet detected by the thickness detection portion.

8. The image forming apparatus according to claim 7, wherein the thickness detection portion detects the thickness of the booklet, which is nipped and held by the pair of holding members, by measuring the space between the pair of the holding members.

9. The image forming apparatus according to claim 6, further comprising:

a positioning portion that positions the spine of the booklet to a predetermined location, wherein the pressing portion presses the spine of the booklet positioned by the positioning portion.

10. The image forming apparatus according to claim 9, wherein the positioning portion has an entering amount to the gap between the pair of holding portions smaller than that of the pressing portion.

11. An image forming system comprising:

an image forming portion that forms an image on a sheet that forms a booklet;

an input portion that inputs information of a sheet on which an image is to be formed; and a sheet processing portion which selectively performs a process on the sheet having an image formed thereon, wherein the sheet processing portion includes:

a holding portion that nips and holds a booklet, which includes folded sheets, by a pair of holding members opposite to each other; and a pressing portion that enters a gap between the pair of holding members, wherein the pressing portion presses the spine of the held booklet so as to deform the spine of the booklet;

wherein the pressing portion has a plurality of pressing members, each having a different thickness in a thickness direction of the booklet, and a selected pressing member among the pluralty of pressing members, which is capable of entering the gap between the pair of holding members and which has a thickness closest to a thickness of the booklet which is nipped and held by the pair of holding members, is selected so as to perform the deforming of the spine of the booklet, and wherein the sheet processing portion selects the selected pressing member according to the calculated thickness of the booklet based on the input information.

* * * * *